US010687622B2

(12) United States Patent
Poppendiek et al.

(10) Patent No.: US 10,687,622 B2
(45) Date of Patent: Jun. 23, 2020

(54) FRAME FOR A DRAWER

(71) Applicant: PAUL HETTICH GMBH & CO. KG., Kirchlengern (DE)

(72) Inventors: Sebastian Poppendiek, Bunde (DE); Jörg Hohmann, Herford (DE); Christian Heimann, Bunde (DE); Stefan Rüter, Bad Oeynhausen (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 16/325,479

(22) PCT Filed: Aug. 10, 2017

(86) PCT No.: PCT/EP2017/070293
§ 371 (c)(1),
(2) Date: Feb. 14, 2019

(87) PCT Pub. No.: WO2018/033464
PCT Pub. Date: Feb. 22, 2018

(65) Prior Publication Data

US 2019/0191877 A1 Jun. 27, 2019

(30) Foreign Application Priority Data

Aug. 15, 2016 (DE) ..... 10 2016 115 084
May 11, 2017 (DE) ..... 10 2017 110 287

(51) Int. Cl.
*A47B 88/00* (2017.01)
*A47B 88/925* (2017.01)
(Continued)

(52) U.S. Cl.
CPC ..... *A47B 88/925* (2017.01); *A47B 88/00* (2013.01); *A47B 88/941* (2017.01); *A47B 88/956* (2017.01); *A47B 2210/02* (2013.01)

(58) Field of Classification Search
CPC ..... A47B 88/925; A47B 88/941; A47B 88/00; A47B 88/95; A47B 88/956
See application file for complete search history.

(56) References Cited

U.S. PATENT DOCUMENTS 3,652,119 A 3/1972 Hall
6,412,893 B1 * 7/2002 Muterthies ..... A47B 88/941 312/330.1

(Continued)

FOREIGN PATENT DOCUMENTS

DE 20203551 U1 5/2002
DE 202005008286 * 10/2006

(Continued)

OTHER PUBLICATIONS

English Translation of Blum GmbH Julius (DE20203551) 2019.

(Continued)

*Primary Examiner* — Kimberley S Wright
(74) *Attorney, Agent, or Firm* — Barnes & Thornburg LLP

(57) ABSTRACT

A frame for a drawer having a base and at least one such frame, wherein the frame has an inner shell and an outer shell fastened to the inner shell, wherein a vertically upper contact region or a gap between the outer shell and the inner shell is covered by a cover strip.

20 Claims, 36 Drawing Sheets

(51) Int. Cl.
*A47B 88/956* (2017.01)
*A47B 88/90* (2017.01)

(56) References Cited

U.S. PATENT DOCUMENTS

| | | | |
|---|---|---|---|
| 2006/0005502 | A1 | 1/2006 | Bodingbauer |
| 2014/0285080 | A1 | 9/2014 | Feuerstein |
| 2016/0007744 | A1 | 1/2016 | Fasino |

FOREIGN PATENT DOCUMENTS

| | | | |
|---|---|---|---|
| DE | 202005008286 | U1 | 10/2006 |
| DE | 102010060722 | | 5/2012 |
| DE | 102011050442 | | 11/2012 |
| DE | 102015105131 | | 10/2016 |
| EP | 1614369 | | 1/2006 |

OTHER PUBLICATIONS

Office Action issued in U.S. Appl. No. 16/325,481 (dated Sep. 11, 2019).
Search Report issued in German Appl. No. 10 2017 110286.8 (2017).
Search Report issued in German Appl. No. 10 2017 110287.6 (2017).
Search and Written Opinion issued in Int'l Appl. No. PCT/EP2017/070293 (2017).
Search and Written Opinion issued in Int'l Appl. No. PCT/EP2017/070294 (2017).

* cited by examiner

FRAME FOR A DRAWER

CROSS-REFERENCE TO RELATED APPLICATIONS

This application is a U.S. nationalization under 35 U.S.C. § 371 of International Application No. PCT/EP2017/070293, filed 10 Aug. 2017, which claims priority to German Patent Application No. 10 2016 115 084.3, filed 15 Aug. 2016 and German Patent Application No. 10 2017 110 287.6, filed 11 May 2017. The disclosures set forth in the referenced applications are incorporated herein by reference in their entireties.

The present disclosure is directed to a frame for a drawer according to the preamble of claim 1.

DE 10 2010 060 722 A1 discloses a frame having a connecting fitting as a functional device which with a base section is mounted to or formed on a frame adapter of a drawer frame. A release lever that can be operated manually is hinged to a locking lever and to the base section and extends into a free space in the frame adapter so that it can be operated manually by a user in the free space. The frame has proven itself well in practice, but requires a relatively large construction width.

For the realization of a frame with a narrower design, a structure with an inner shell and an outer shell is useful. The present disclosure is directed to a frame having a structure that may be realized in a variety of embodiments.

In an embodiment, a frame for a drawer includes an inner shell and an outer shell attached to the inner shell, wherein a vertically upper contact region or a gap between the outer shell and the inner shell is covered by a cover strip. In the same way as a decorative strip or function strip, this cover strip may provide optical and functional variants of the frame without having to fundamentally change the structure of the frame. Thus, different colored and/or differently shaped cover strips can be provided in order to be able to change the design of the frame upwards in a simple way to suit the individual customer and/or in order to be able to realize attachments or the like on the frame in a simple way. The decorative strip complements the inner shell and the outer shell to form a shell that can also be designated as a three-part shell.

In an embodiment, the cover strip may cover the edges of the outer shell and the inner shell vertically upwards.

In illustrative embodiments, the outer shell and the inner shell are slidably guided relative to each other by one or two sliding guides, and the one or at least one of the at least two sliding guides may include one or more guide element(s) disposed between said outer shell and said inner shell.

In an embodiment, the one of the sliding guides can be constructed as an upper sliding guide and the at least one other of the sliding guides can be constructed as at least one lower sliding guide between the inner shell and the outer shell, and at least the upper sliding guide and/or the at least one lower sliding guide can have one or more guide elements arranged between the outer shell and the inner shell. This makes it possible to design sliding guides between an inner shell and an outer shell that are adapted to the respective design conditions. For example, on inner and outer steel shells, sliding guides cannot be formed directly between the inner and outer shells, or only with great design effort. This problem may be solved by the guide elements provided on the respective sliding guide. In an embodiment, the guide elements may be attached to the inner shell or the outer shell, for example, releasably, so that the corresponding component outer shell or inner shell can slide along them. The frame may have a type of elongated shell-type housing at least with an outer shell and an inner shell, between which a cavity is formed which is thus easily accessible.

The term "sliding guide" means that a first element is slidably guided on a second element and slides directly or indirectly on said second element. The sliding guide can, for example, be formed by a web of an element which slides on two or three sides, for example in a corner area or in a guide groove of a corresponding element. The guide groove can be formed directly in the inner or outer shell or in another guide element attached to it.

In an embodiment, one or more of the upper guide elements may be integrally formed with the cover strip. In this way, two functions—cover and sliding guide—may be integrated into one component. However, another embodiment may also provide for the cover strip to be arranged on or fastened to one or more of the upper guide elements, for example, to be arranged thereon in a slidable manner. This means that the cover strip and one or more of the guide elements may be designed in one piece as an integral unit or assembled to form one unit.

In an embodiment, the cover strip is T-shaped in cross-section and has a horizontal leg and a vertical leg. In this way, the functions of fastening—e.g. by locking the longitudinal leg to another element of the frame—and covering—through the transverse leg—are very easy to combine. However, it can also be provided that the cover strip is F-shaped in cross-section and has one horizontal leg and two vertical legs. The second transverse leg can then function as a lateral cover. Otherwise, the function is preferably the same as for the explained T-shape. in any event, the horizontal leg of the cover strip may be designed as a cover leg which covers not only a gap or contact region but also a receiving channel of the frame in the upwards direction.

It may also be provided that the one vertical leg of the cover strip is designed as a cover leg which covers the receiving channel of the frame on one side.

For the realization of a wide range of cover strip variants, it may also be provided that the cover strip has a strip base for attachment to the frame, which is provided with an upper mounting leg on which a cover strip or a function strip or a function element is mounted. Embodiments of these features are explained below with reference to the figures.

According to—an embodiment, the at least two sliding guides merely provide a linearly limited displaceability of the outer shell relative to the inner shell, as this is usually sufficient to advantageously ensure sufficient access to the interior space between the inner shell and the outer shell.

In an embodiment, the outer shell and/or the inner shell may be formed from one or more steel elements, in particular steel sheets. However, it is also suitable for the inner and outer shells made of other materials, such as light metal, for example, aluminum. Unlike extruded profiles, webs or grooves cannot be easily formed on steel sheets. The guide elements may remedy this shortcoming.

In order to achieve good sliding properties and to provide the guide elements with a suitable geometry and shape in a simple way, the guide elements may be made of plastic.

In an embodiment, one of the sliding guides is designed as an upper sliding guide and the at least one other of the sliding guides is designed as at least one lower sliding guide between the inner shell and the outer shell, and that at least the upper sliding guide and/or the at least one lower sliding guides each have one or more guide elements arranged between the outer shell and the inner shell. The terms "lower" and "upper" refer to a vertical direction in an installation position of the frame on a drawer to an installation position closer—lower—relative to the drawer bottom and to an upper installation position further away from this drawer bottom.

In an embodiment, the guide elements may each be arranged in a receiving channel formed between the inner shell and the outer shell. The receiving channel may be formed by at least three or four walls, wherein at least one wall projects above the guide elements in its height. Two walls extending almost parallel to each other in vertical alignment with the drawer bottom are may have the same height. In this way, the guide elements are well protected and are visually concealed (with regard to the position of use of the drawer with a frame on a piece of furniture according to the invention) from the outer shell and the inner shell in the respective receiving channel. This channel may be completely or essentially completely covered by the cover strip.

In an embodiment, two of the walls of the at least one receiving channel are formed by the inner shell and one of the walls of the receiving channel is formed by the outer shell. The upper guide elements may be attached to the inner shell so that the outer shell is guided by the upper guide elements.

The guide elements may each be fastened to the inner shell or to the outer shell and the respectively corresponding element—the outer shell or the inner shell—may have a guide groove formed correspondingly to the guide element and in the area of which the outer shell or the inner shell is slidably guided on the guide element or elements.

In an embodiment, the frame has two different lower sliding guides between the inner shell and the outer shell and that both of the lower sliding guides each have one or more of the guide elements arranged between the outer shell and the inner shell. In this way, limited mobility can be achieved in the lower area between the inner shell and the outer shell, which is sufficient to allow access to functional elements in the interior between the inner shell and the outer shell. In addition, it is thus possible to position the outer shell and the inner shell very precisely relative to each other.

It is conceivable that the guide elements of the sliding guides are each fastened to the inner shell and/or to the outer shell.

The guide elements may engage displaceably in a guide groove of the corresponding element of the outer shell or inner shell.

In an embodiment, one or more sliding and/or positioning means are formed on one or more of the upper guide elements for fastening and/or positioning the top element "cover strip". In this way, at least one upper guide element may assume multiple functions.

In an embodiment, within the framework of the realization of the multiple function, sliding guide means may be provided on one or more of the upper guide elements, on which the cover strip is slidably guided with corresponding sliding guide means.

The upper guide elements may thus be used both for the function of the sliding guide between the inner and outer shell and for the realization of other frame variants with the cover strip, with which, for example, other colors or shapes can be realized on the frame.

Sliding guide means may be provided on the upper guide elements on which the cover strip is slidably guided with corresponding sliding guide means. In this way, two sliding guides are formed simultaneously on the upper guide rails. On the one hand this is the sliding guide between the inner and outer shell and on the other hand it is a sliding guide for the cover strip relative to one of the elements inner and outer shell.

The corresponding sliding guide means may form a tongue-and-groove sliding guide in their interaction.

In an embodiment, the one type of lower guide element may be fixed to the inner shell and slidably guided directly or indirectly on the outer shell and the other type of lower guide element may be fixed to the outer shell and slidably guided directly or indirectly on the inner shell.

With regard to the assembly of the guide elements, at least some of the lower and/or upper guide elements may be fixed to the inner shell or the outer shell in a latching manner.

The upper and lower guide elements can be identical or different in design. The upper and/or lower guide elements as a whole may be attached to the inner shell or outer shell. However, in other embodiments, some of the guide elements may be fixed to the inner shell and some of the guide elements may be fixed to the outer shell.

In embodiments, frames can be produced in which the inner and/or outer shell, which may be made of sheet steel, together form a body being essentially rectangular in cross-section with a maximum width $B_3$ of less than 15 mm.

BRIEF DESCRIPTION OF THE DRAWINGS

FIG. 1 shows a piece of furniture designed as cabinet furniture 2. The cabinet furniture 2 has a furniture body 3. Three drawers 4, 5 are inserted here in furniture body 3 by way of example. The drawers 4, 5 are slidably guided in the furniture body 3 so that each of the drawers 4, 5 can be pulled out of the furniture body 3 into an open position and pushed back again into a closed position.

Figure 1:
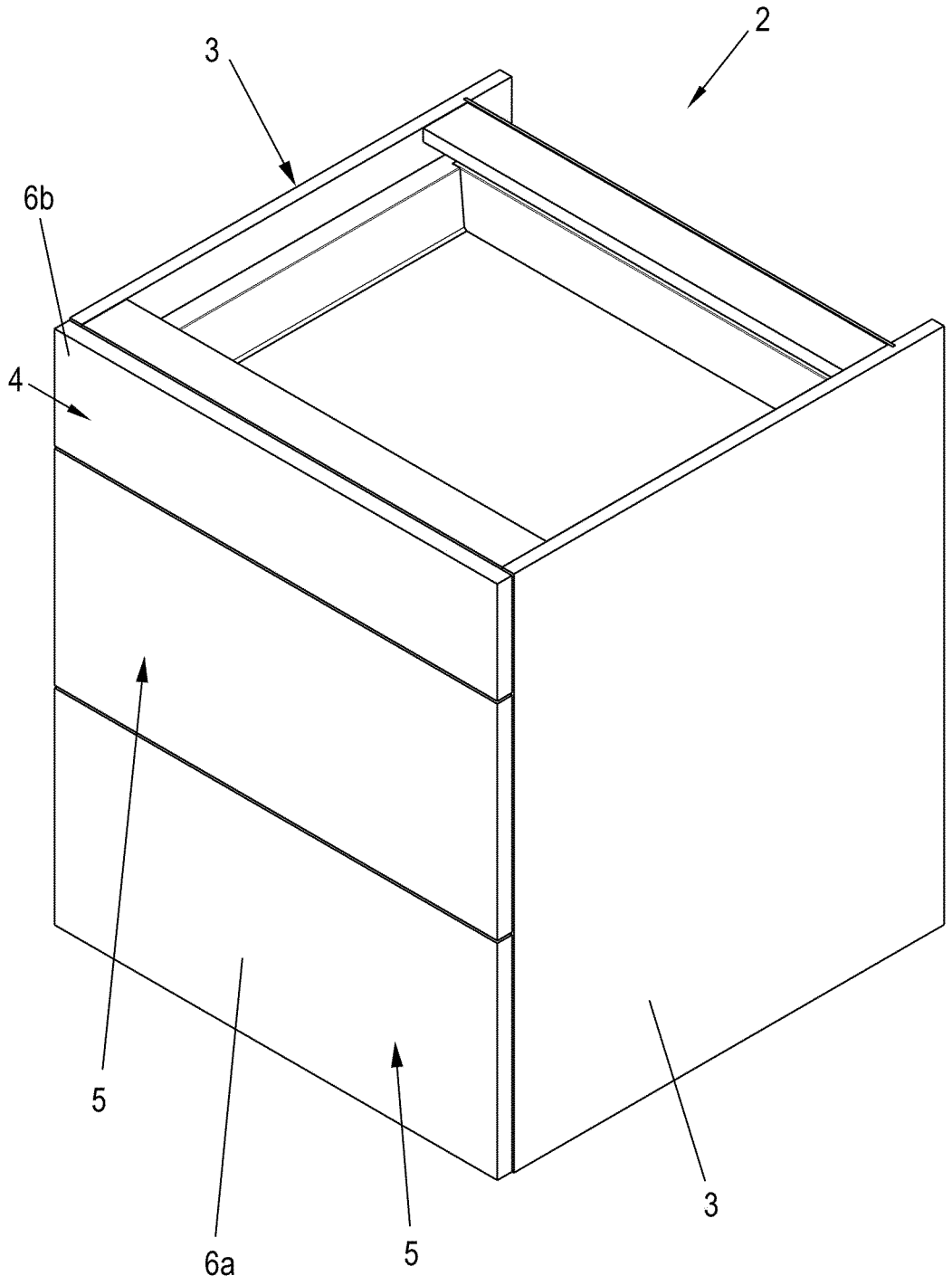
FIG. 1: shows a spatial view of a piece of cabinet furniture with three drawers that are closed.
Figure 2A:
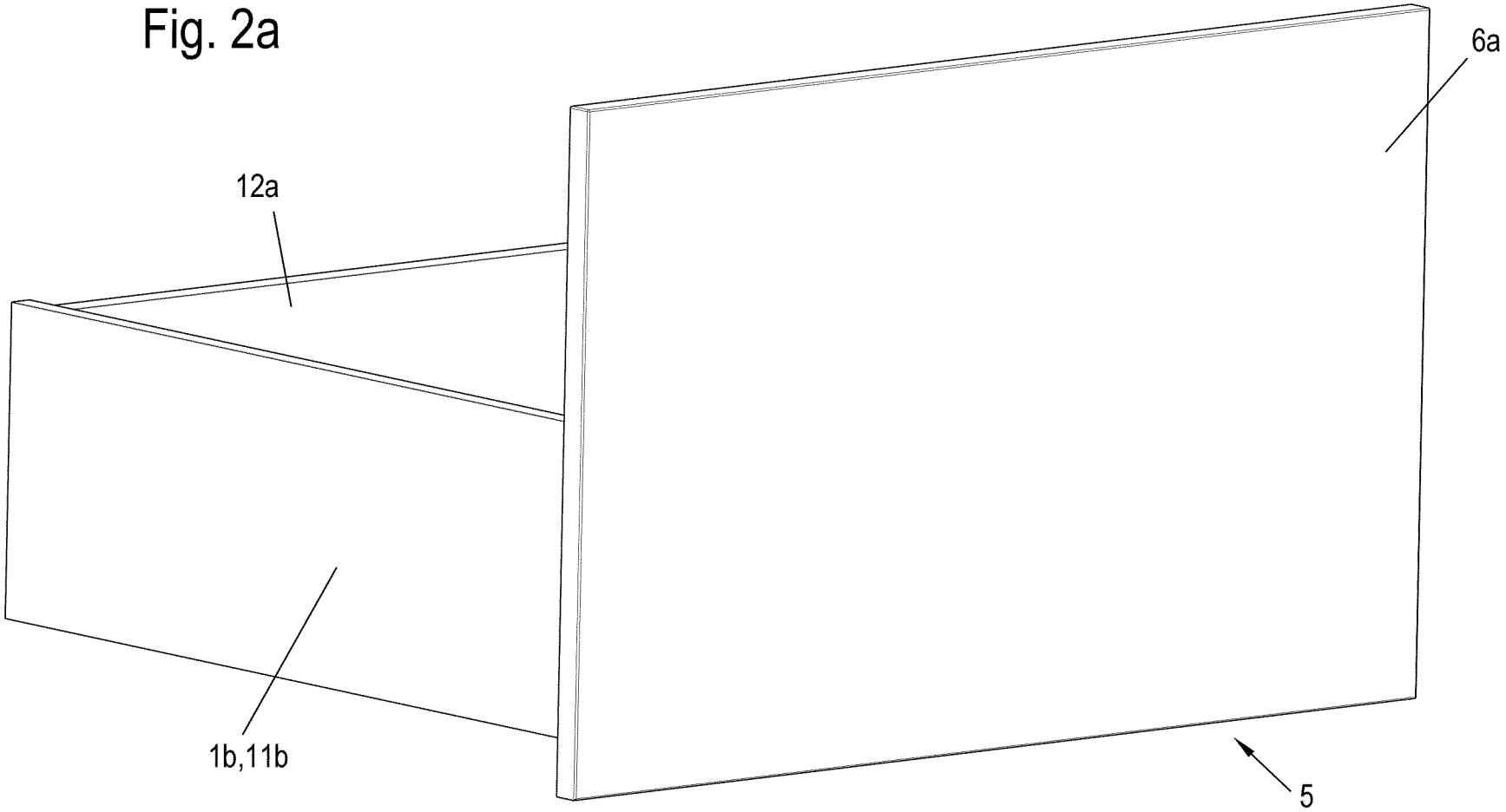
FIG. 2*a*: shows a spatial view of one of the drawers from FIG. 1, having a front panel and (side) frames, one of which is recognizable.

The drawer 5 illustrated in FIGS. 2*a* and *b* has a front panel 6*a*, which in this case is designed as a relatively high front panel 6*a* as an example. Drawer 5 also has two side frames—hereinafter also referred to as frames 1. The frames 1 are preferably constructed with two shells. The frame has a kind of elongated shell-like housing with an outer shell 11 and an inner shell 10.

The outer shell 11 is held on the inner shell 10 and can be moved relative to it. Preferably, the outer shell is held on the inner shell so that it can be moved to a limited extent. The inner shell 10 has a narrow cavity in each case with the outer shell 11.

The term "inner shell 10" and "outer shell 11" does not mean that they each have to be constructed in one piece. The inner shell 10 and the outer shell 11 can instead be composed of several elements such as metal strips, so that these metal strips interact to form the inner shell and the outer shell 10, 11.

Drawer 5 also has a rear panel 12*a* and a drawer bottom 12*b*. In an embodiment, the outer shell 11 and the inner shell 10 are made of sheet metal, especially sheet steel. However, they can also be made of other materials. In an embodiment, the inner shell 10 and the outer shell 11 are each manufactured in one piece or in several pieces from one or more sheet(s), for example, of steel, which have been bent over to form sections and on which, as may be desired, recesses and the like are formed by punching, cutting or the like.

Figure 3A:
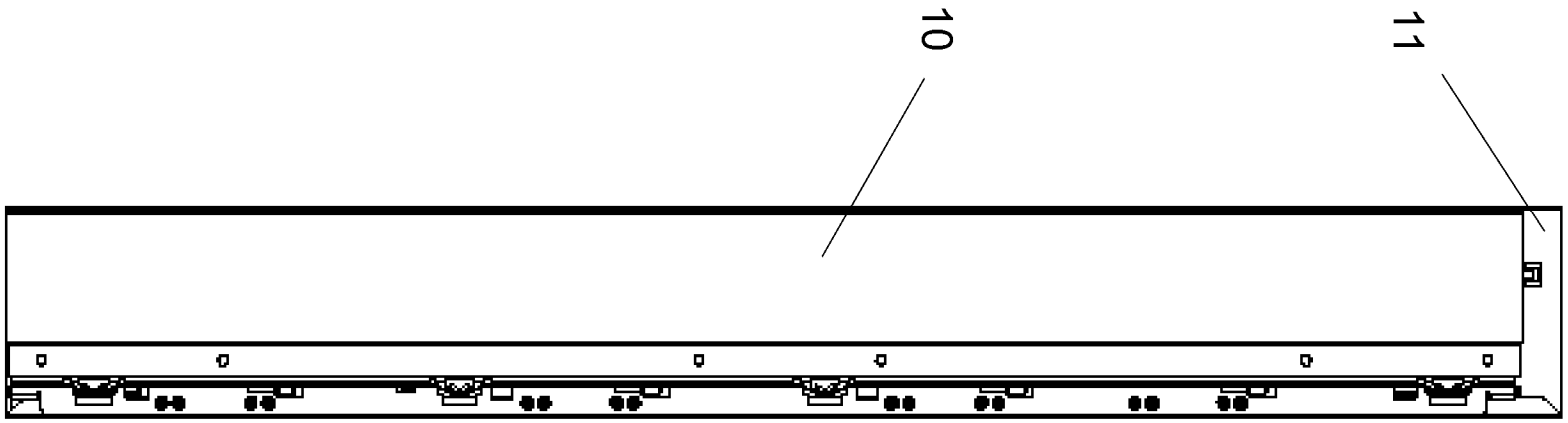
FIG. 3 shows in a) a front view of a frame with a two-part shell, in b) a side view of the frame from a) with functional elements arranged in the shell and in c) an exploded view of the shell from a) and b)

The outer shell 11 and the inner shell 10 may form a frame with a relatively small, i.e. "narrow", construction width, which (perpendicular to FIG. 3*a*) is preferably less than 15 mm, in particular narrower than 12 mm.

Figure 2B:
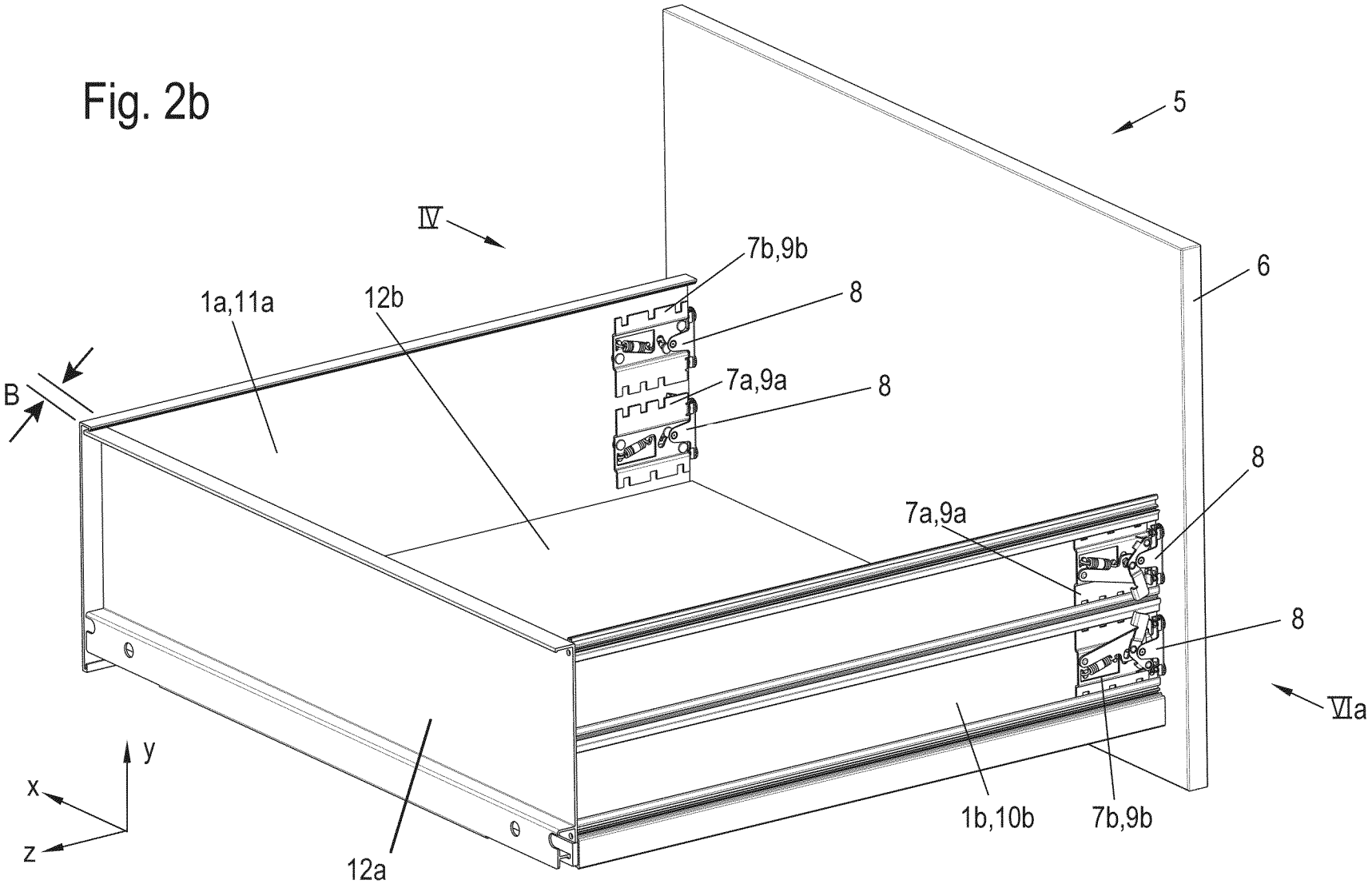
FIG. 2*b*: shows a spatial view of the drawer from FIG. 2*a*, wherein an outer shell of the frame is not shown in the left frame as seen by the drawer operator and in which the inner shell of the other frame is not shown in the right frame as seen by the drawer operator.

FIG. 2*b* does not show the outer shell 11 of the frame 1 of drawer 5 which is on the left as seen by the operator of drawer 5 and the inner shell 10 of the frame 1 which is on the right as seen by the operator of drawer 5.

Several functional devices are arranged on each of the frames 1, which are essentially arranged in the installation space between the outer shell 11 and the inner shell 10. Such functional devices may include, for example, one or more locking devices and one or more fastening elements. The drawer in the area of each of the two frames 1 has at least one, here two connecting fittings 7*a*, 7*b*, with each of which the front panel 6*a* can be attached to the frame.

For this purpose, the front panel 6*a* of each connecting fitting 7*a*, 7*b* can be connected or is connected in the assembled state to a corresponding locking device 9*a*, 9*b* on the corresponding frame 1 on the left or right via a carrying device 8.

Drawer 4 with low front panel 6*b* has the same design as drawer 5 with high front panel 6*a*. Differences between the two drawers 4, 5 exist in particular in the height of the front panel 6*a* or 6*b* (and possibly the rear panel) and thus in the height of the frames 1, which are correspondingly lower in the case of drawer 4 with a low front panel 6*b*. As a result, the frames 1 of the drawer 4 with low front panel 6*b* have only one locking device 9*a* or 9*b*.

Figure 16:
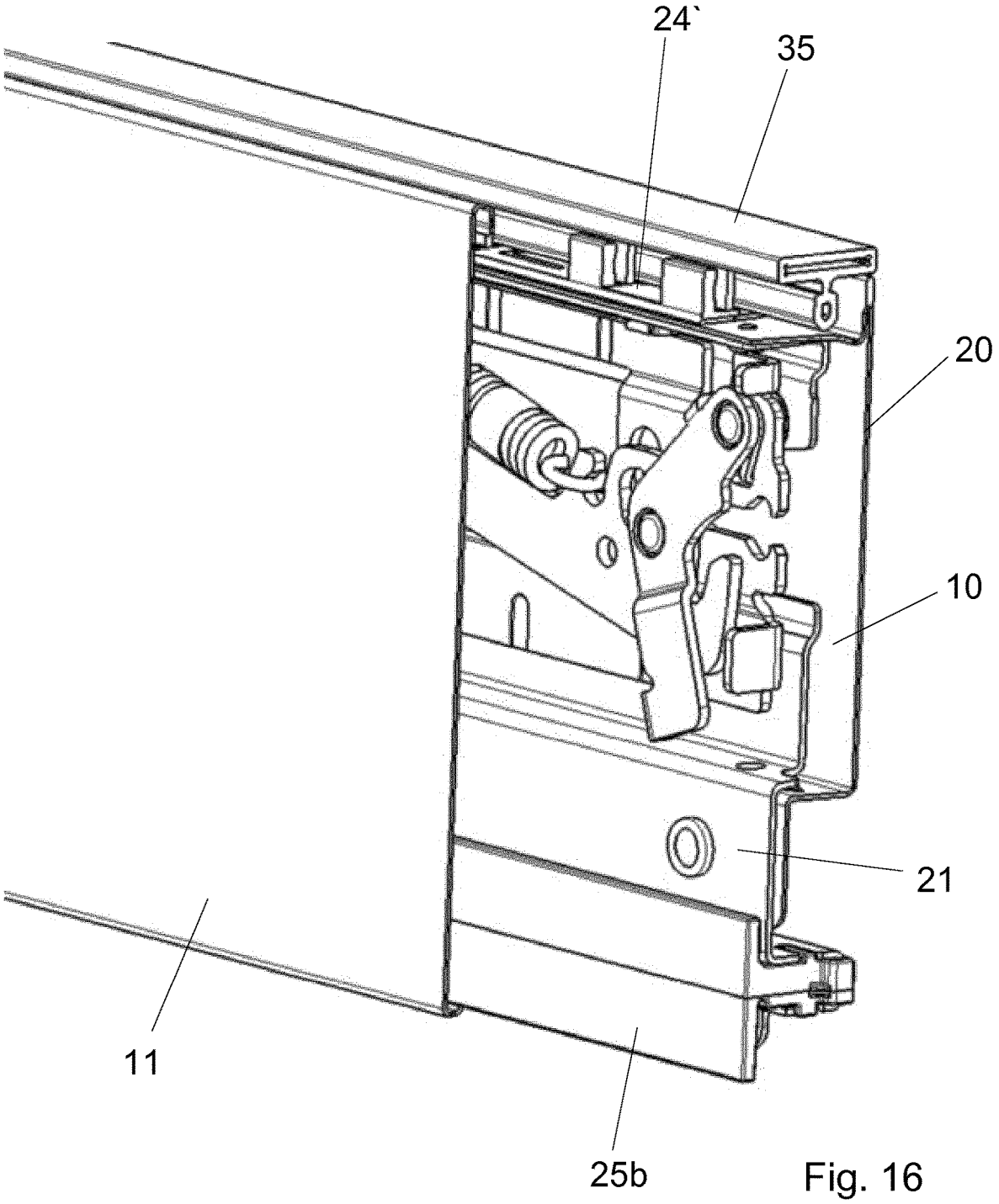
FIG. 16 shows a perspective view of the frame from FIG. 15 with a three-part shell with an inner shell displaced relative to the outer shell.
Figure 17:
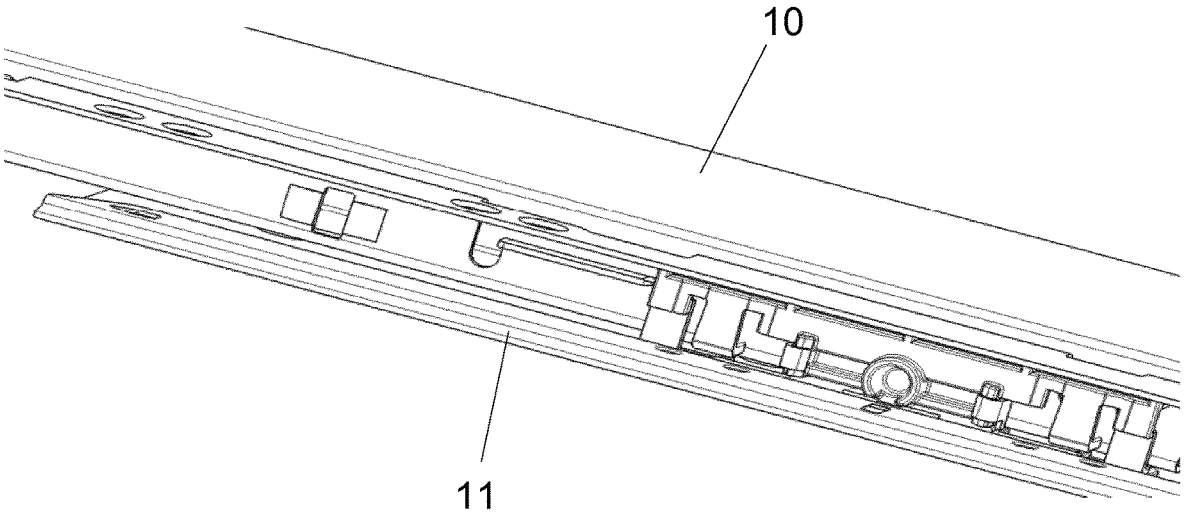
FIG. 17 shows a further perspective view of a partial area of the arrangement from FIG. 16.
Figure 18A:
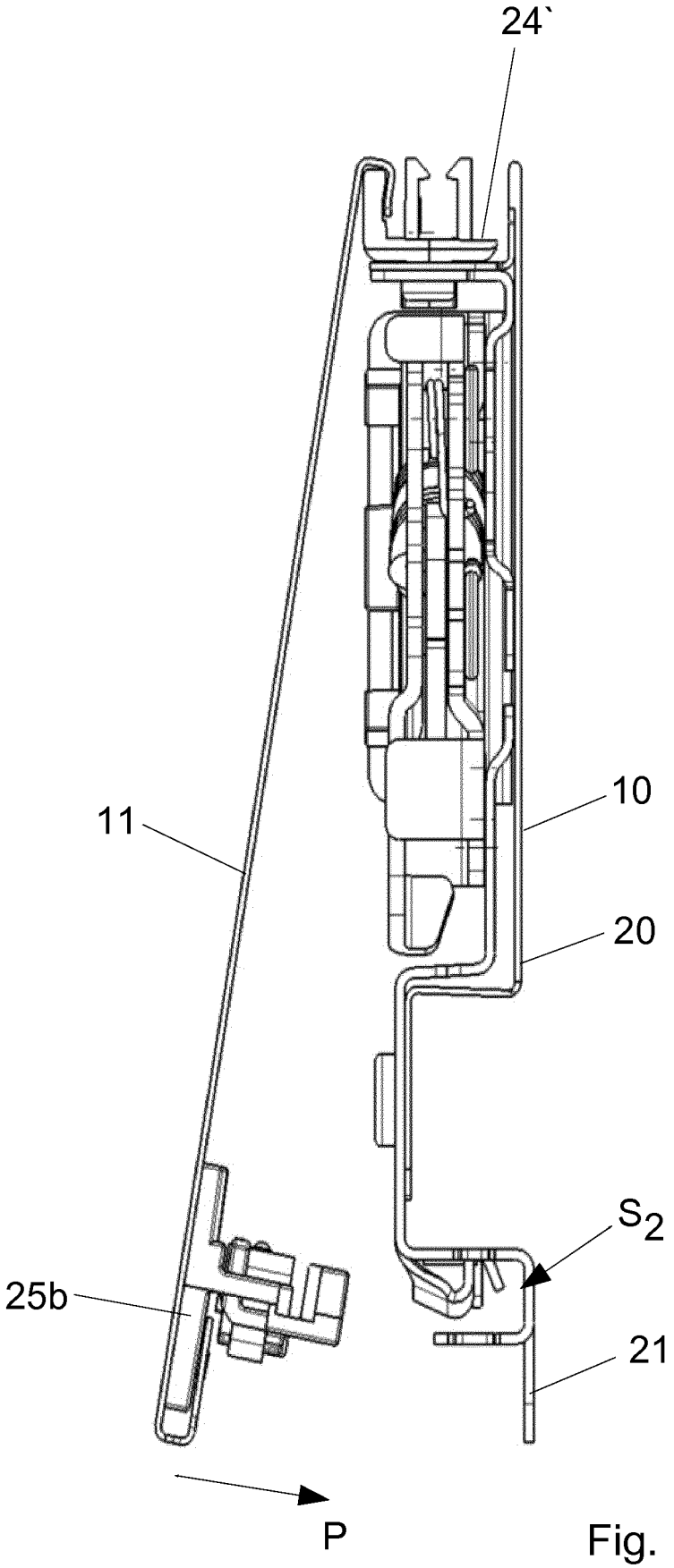
FIG. 18 shows in a) to b) views to illustrate an assembly of an outer shell to an inner shell in steps.
Figure 18B:
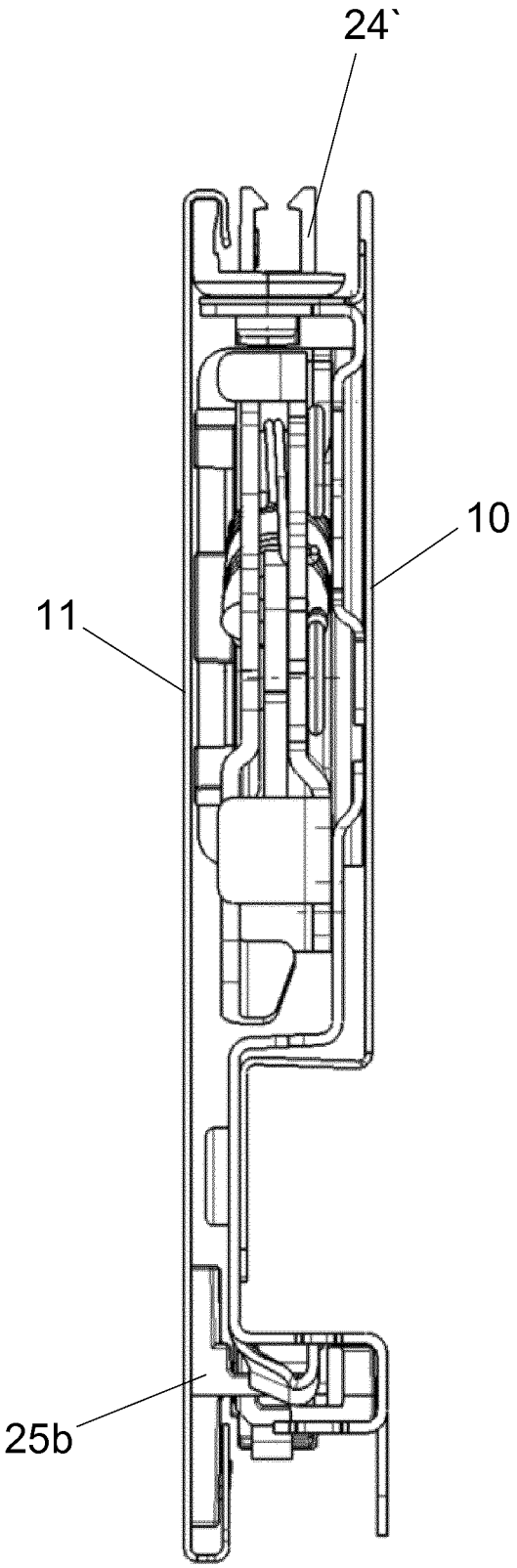

In order to provide access to the functional element(s) located wholly or partially in the intermediate space between the inner shell 10 and the outer shell 11, the inner shell 10 may be displaceable relative to the outer shell 11, for example, with limited displacement (for illustration see for example FIG. 16).

In an embodiment, the outer shell 11 is designed in one piece. The outer shell 11 also has an outer wall section 13, which essentially or completely forms the visible outer wall of the frame 10 on the outer wall/side facing away from the drawer bottom 12*b*. Towards the rear wall 12*a*, the inner shell 11 here is shorter by its width B than the outer shell 11.

Figure 3B:
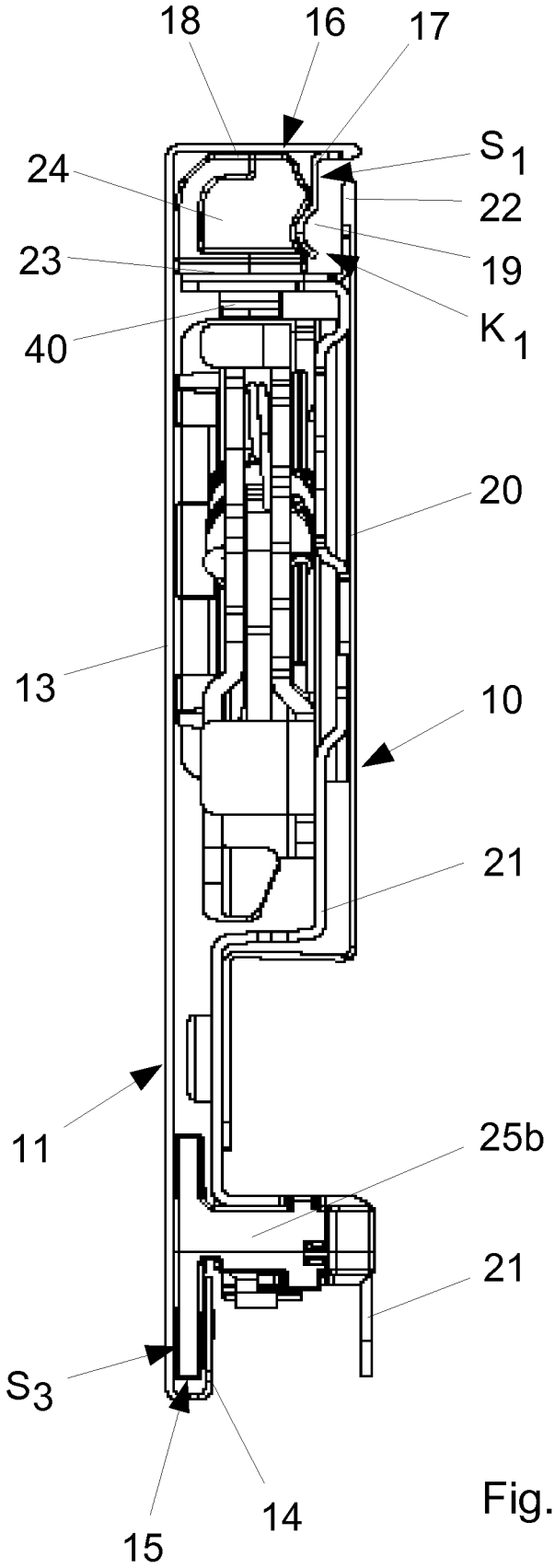

A lower edge 14 of this outer wall section 13 may be bent 180° towards the inner shell 10. A channel-like lower guide groove 15 may be formed on the outer shell 11 (FIG. 3*b*).

Furthermore, an upper edge 16 of this outer wall section 13 may be bent by a total of approx. 180° towards the inner shell 10, so that also a channel-like upper guide groove 17 is formed.

The upper edge 16 may form a resiliently acting angulation 19 which extends downwards from the cover strip section 18. Thus the upper edge 16, together with the cover strip section 18 and the angulation 19, may jointly form the upper channel-like guide groove 17 on the outer shell 11. Accorln an embodiment, the inner shell 10 is designed in two pieces. However, it can also be integral or consist of more than two metal sheets (not shown here). Here the inner shell 10 has an inner wall section 20 and a container rail 21 attached to the inner wall section 20 with one or more attachment points, wherein these points can be produced by joining methods such as riveting, clinching or welding.

One or more of the functional elements described above is/are defined on the container rail 21. Such construction may increase the stability of the respective frame 1 and simplify assembly.

The inner wall section 20 serves, among other things, to optically cover frame 1 towards the inside—i.e. towards the drawer bottom 12*b*.

The upper edge 22 of the inner wall section 20 (and here also that of the container rail)—see FIG. 3*b*—is bent outwards or towards the outer shell 11 in such a way that it lies below the upper guide groove 17 and forms a carrying leg 23 there in the manner of a cross beam. Between the carrying leg 23 and the inner and outer shells 10, 11, an upper receiving channel K1 is thus formed towards the upper edge area.

The carrying leg 23 is used here to fasten one or more first—upper—guide elements 24. These are arranged in the upper receiving channel K1 and are well protected and optically concealed there. The outer shell 11 glides on them. They therefore form a first, upper sliding guide S1 with the outer shell 11 (see FIG. 3*b*).

In an embodiment, several of the upper guide elements 24 are distributed in a row at a distance from each other on the carrying leg 23 of the inner shell 10. The carrying leg 23 and an adjoining wall area of the inner shell 10 form two of the walls of the upper receiving channel K1. Two other walls of this receiving channel K1 form the outer shell 11. The upper receiving channel K1 is thus closed all around. The upper guide elements 24 are therefore not visible from the outside in their installation position on a drawer.

Figure 3C:
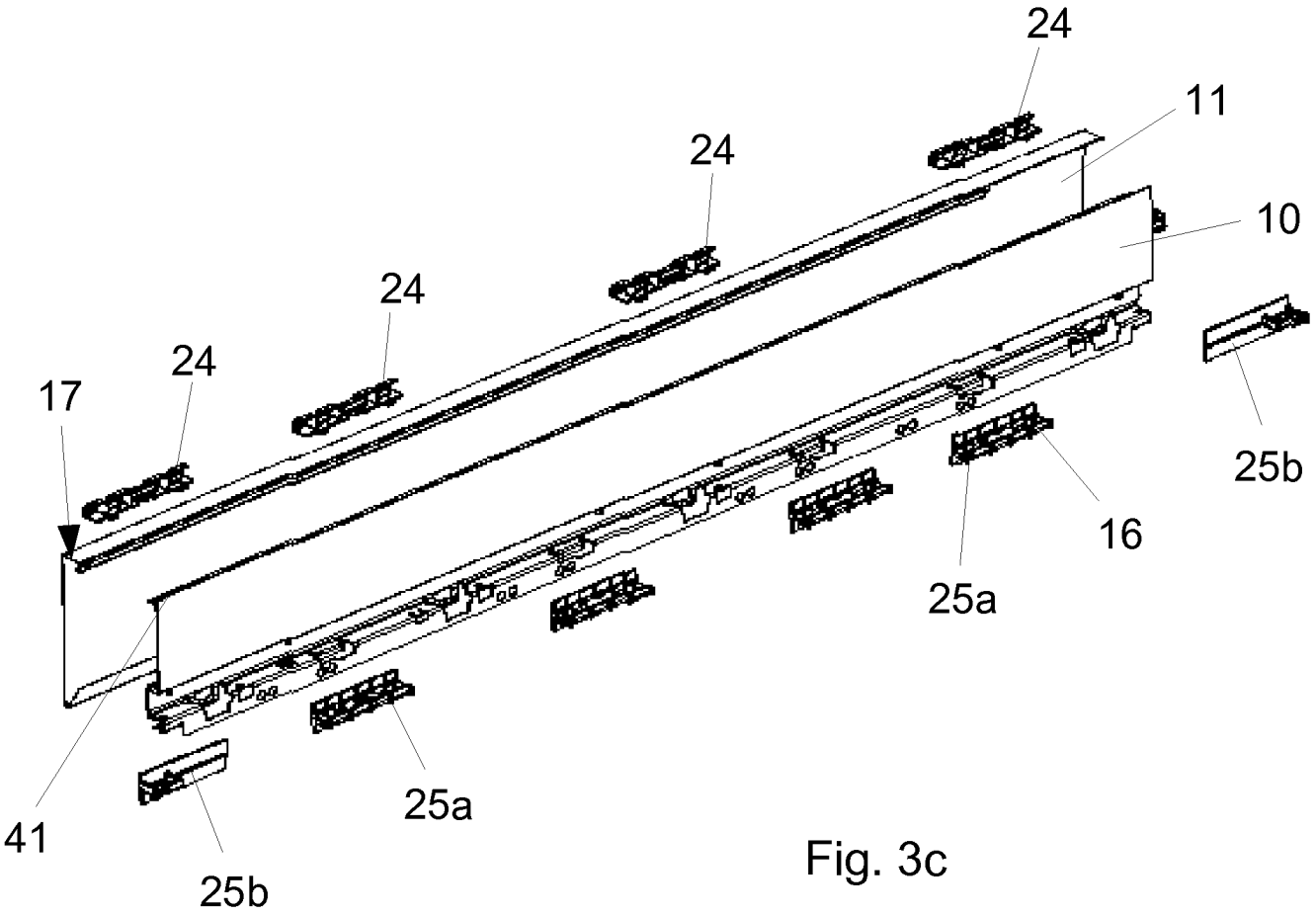

The guide elements 24 can be fixed in a stationary manner in the receiving channel K1, for example, with screws or rivets and/or locking means or the like. In an embodiment, the guide elements may be fastened using at least one detent hook 40 or more detent hooks, which engages/engage into a detent recess 41 of the carrying leg 23 and/or the container rail 21 (FIGS. 3*b* and 3*c*).

The upper (and also the further) guide elements 24 each form sliding elements, wherein according to FIG. 3*b* the upper guide elements engage directly into the upper guide groove 17 of the movable outer shell 11. In this case, the resilient leg rests resiliently on the side of the guide elements 24. In this way, the outer shell 11 is guided in a simple way in the upper area on the guide elements 24 of the inner shell 10 so that it can be moved easily and safely. The first—upper—sliding guide S1 is formed between the outer shell 11 and the inner shell 10.

Since the angulation 19 is preferably designed as a resilient leg, which laterally engages resiliently in a lateral recess 24*a* of the upper guide elements 24, a particularly good fit of the outer shell 11 in this area is achieved on the guide elements 24. In this way, a lift-off safety device for the outer shell 11 from the inner shell 10 can be easily implemented.

The lift-off safety device can also be implemented in other constructive ways.

This one or more upper guide elements 24, 24" (and 50) may be made of a plastic. The latter also applies to further guide elements 25*a*, 25*b* to be explained below.

In addition, the outer shell 11 is also displaceably guided further down—here at the lower edge—towards the inner shell 10 with further guide elements 25*a, b* relative to the inner shell 10.

Figure 5A:
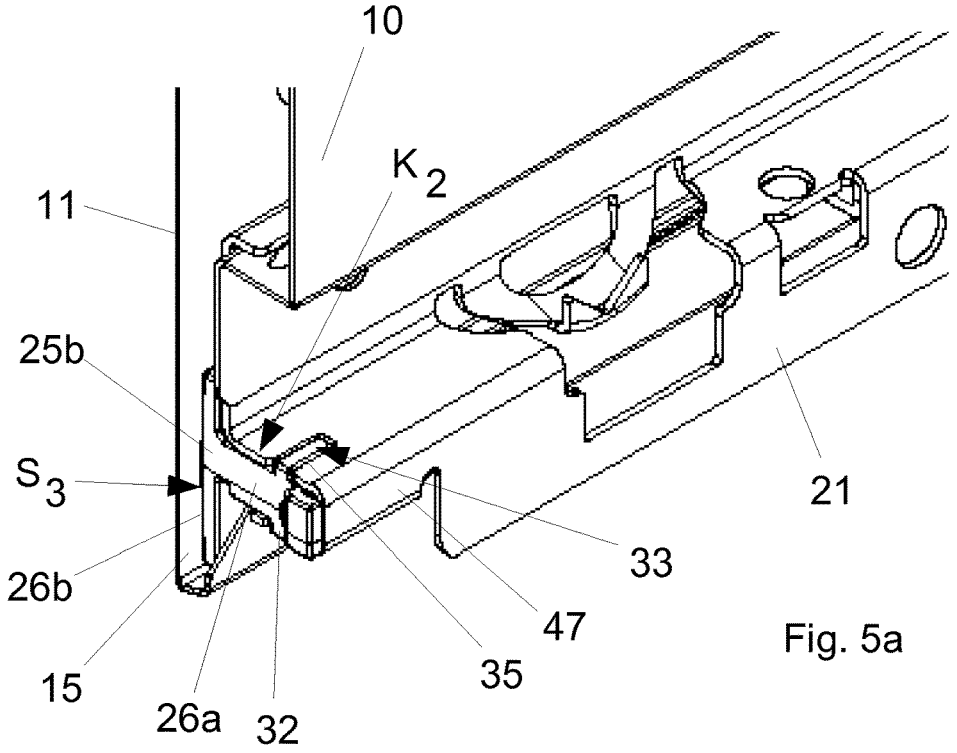
FIG. 5 shows in a) and b) different perspective views of sections of a frame with a guide element of the type shown in FIG. 4 and in c) and d) a side view and a front view of the section from a).

In this area further down, at least one further sliding guide S2 is formed between the inner shell 10 and the outer shell 11. In an embodiment, two further lower sliding guides S2 and S3 are provided (FIG. 3*b* and FIG. 5*a*).

It is conceivable to provide only one type of lower guide element. According to the figures shown, on the other hand, two different types of lower guide elements are provided which are designated 25*a* and 25*b* in the drawings and which are adaptable to the tasks and geometries in the area of the two lower sliding guides S2, S3.

The first lower guide elements 25*a* may be fixed on the outer shell 11 to the lower guide groove 15 using a forming process, preferably in such a way that the joining process leaves no visible traces from the outside. They serve as combined guide and fixing elements and also serve to hold the outer shell 11 on the inner shell 10. The lower middle guide elements 25*a* engage with a vertically aligned guide leg 26*b* fixedly and immovably in the lower groove 15 of the outer shell 11.

Figure 11:
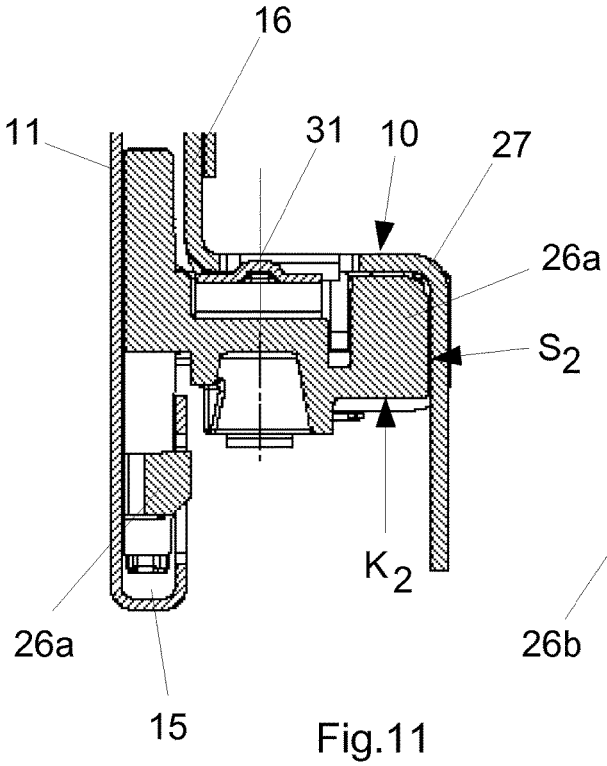
FIG. 11 shows a sectional view through a section of a frame according to the type of FIGS. 1 to 3 and 5 with a guide element according to the type of FIG. 10.
Figure 10:
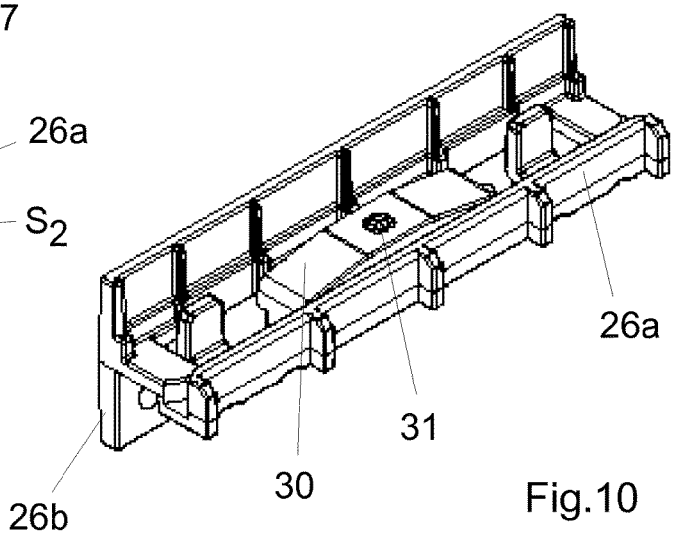
FIG. 10 shows another lower guide element—second type—for a frame, especially in the manner of the preceding figures.

According to FIG. 3*c*, four of these first lower guide elements 25*a* are provided as examples. They preferably have a T-shape in section (see FIGS. 10 and 11). The preassembled guide elements 25*a* on the outer shell 11 carry a horizontally aligned cross beam 27 of the inner shell 10 with a horizontally aligned leg 26*a* after the inner shell 10 has been placed on it. This cross beam 27 limits a lower receiving channel K2 for the lower guide elements 25*a, b* upwards. The one other wall of this receiving channel K2 is formed by the outer shell 11 and the other by the inner shell 10. Since the middle lower guide elements 25*a* are attached to the outer shell 11, the actual sliding guide S2 is formed on these guide elements 25*a* towards the inner shell 10, here on the container rail 21.

The lower middle guide elements 25*a* are thus advantageously positioned between the inner shell 10 and the outer shell 11, where they are concealed and well protected.

Figure 12:
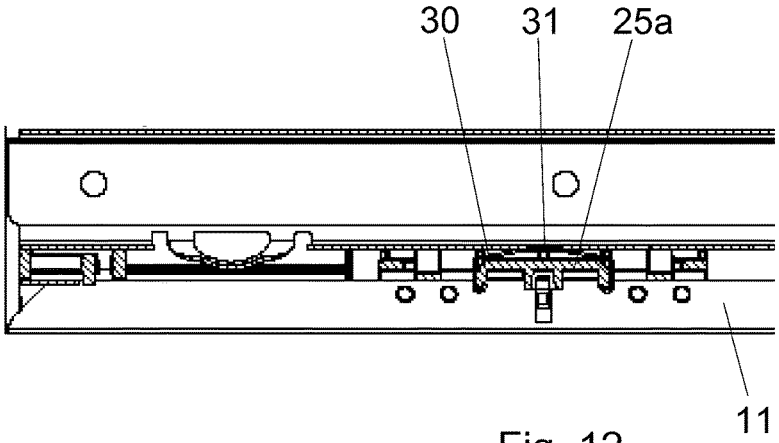
FIG. 12 shows the guide element from FIGS. 10 and 11 on a section of the frame of FIG. 11.

At least one of the central (first lower) guide elements 25*a* secured to the outer shell has a spring element 30—adapted to engage a window or the like of the inner shell upon displacement of the outer shell 11 relative to the inner shell to releasably secure the outer shell 11 relative to the inner shell 10 in a final assembly position which can only be released in a special case such as a maintenance case. Here the spring element 30, for example, a leaf spring, has a detent lug 31, which engages in a latching manner in a window of the inner shell when the outer shell 11 is moved (see FIGS. 10 to 12).

There are also two outer guide elements 25*b*—see FIGS. 4 to 8—which are each provided in the end area (i.e. towards the front panel and towards the rear panel) of frame 1.

These outer guide elements 25*b* stabilize the outer end areas of the frame in the end area of the inner shell 10 and the outer shell 11. They are also arranged in the lower receiving channel K2. However, they are fixed to the inner shell 10 and the outer shell 11 is movable relative to them or on them.

The outer guide elements 25*b* each may have a detent means such as a detent hook 28, which is/are attached to a corresponding detent means—for example to a window 29 of the inner shell 10.

Also the two outer lower guide elements 25*a, b* may be formed in a T-shaped manner in section, so that three legs 26*a, b, c* are formed on them.

The horizontal leg 26*a* has the detent hook 28 and is fixed to the inner shell 10, namely in a receptacle 47 which is U-shaped in section and formed in the end area of the inner shell 10. The lower vertical leg 26*b*, on the other hand, engages in the guide groove 15 of the outer shell 11, which is open vertically upwards, and is slidably guided there.

Figure 5B:
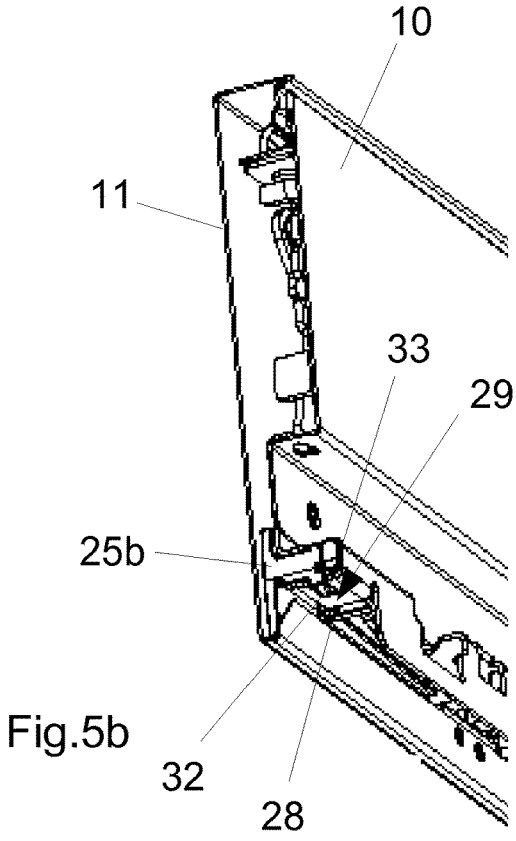
Figure 4:
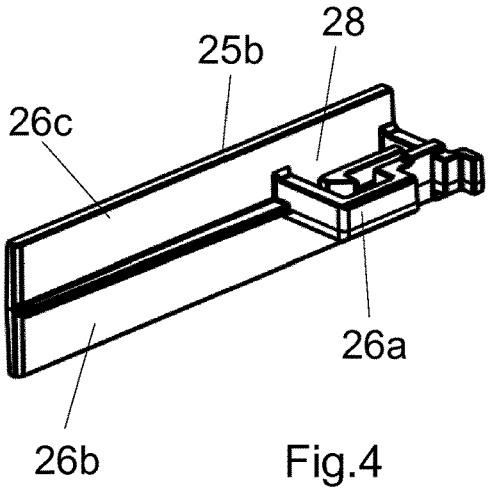
FIG. 4 shows a perspective view of a preferred embodiment of a lower guide element of the first type for a frame, which, for example, is designed according to FIGS. 1 and 2.
Figure 5C:
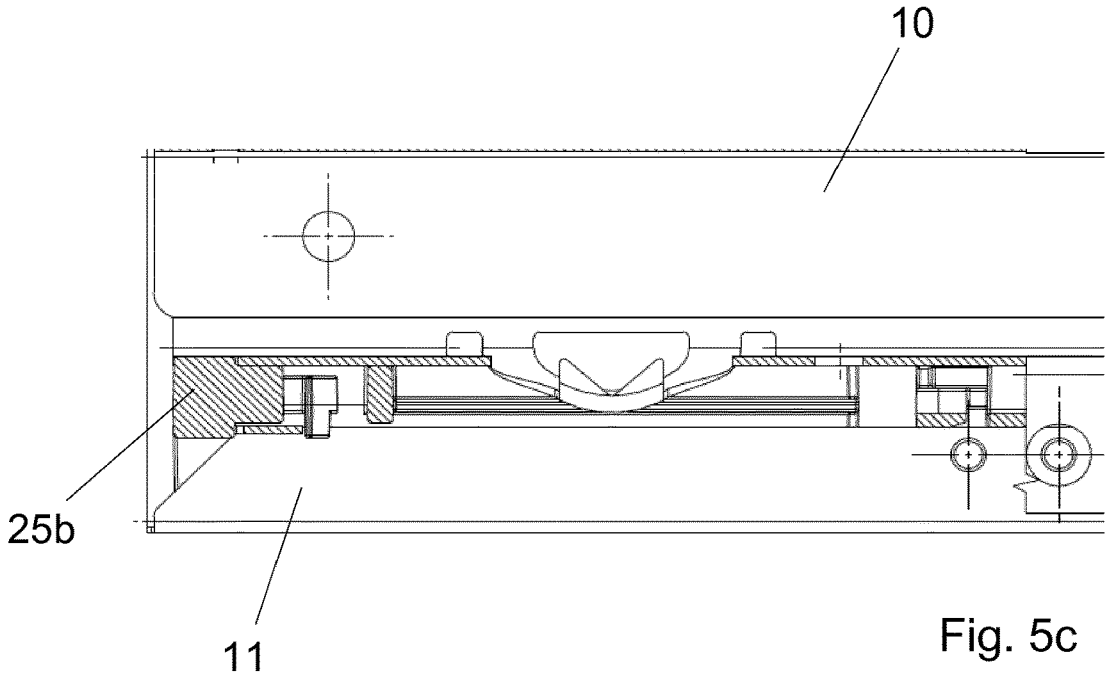
Figure 5D:
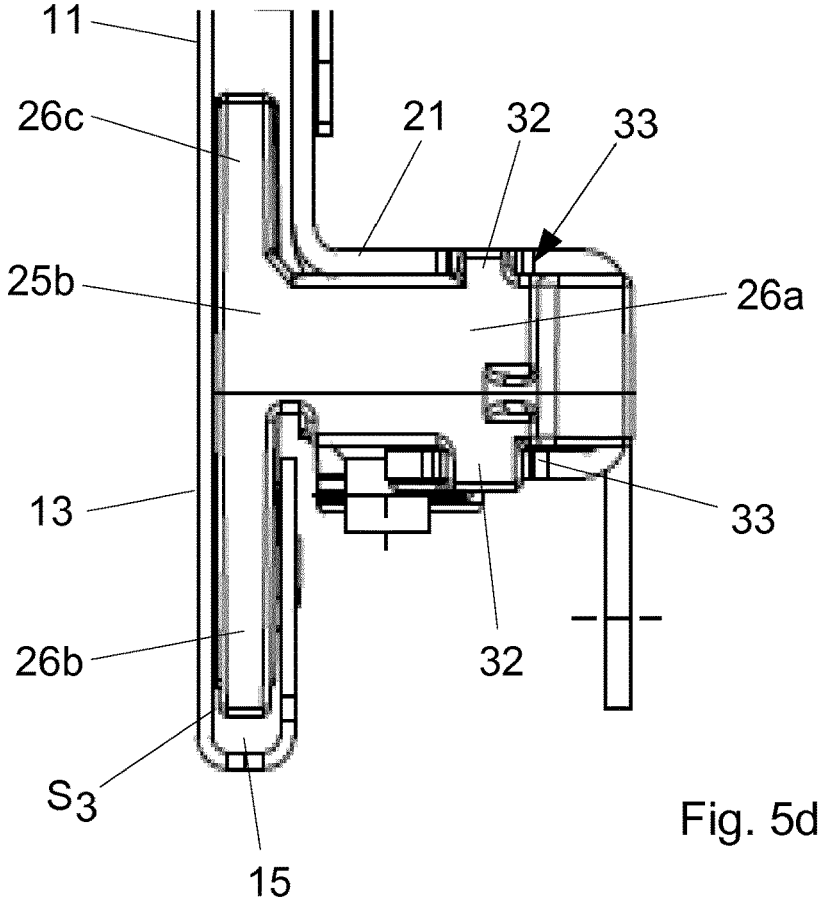
Figure 9:
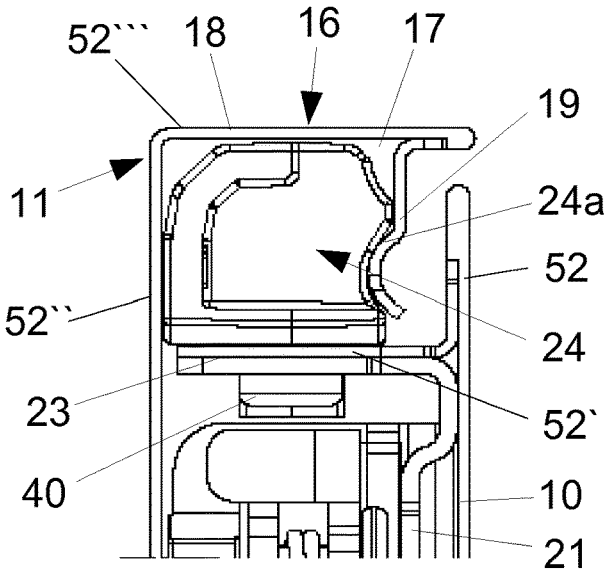
FIG. 9 shows a side view of a section of a frame with the upper guide element.
Figure 8:
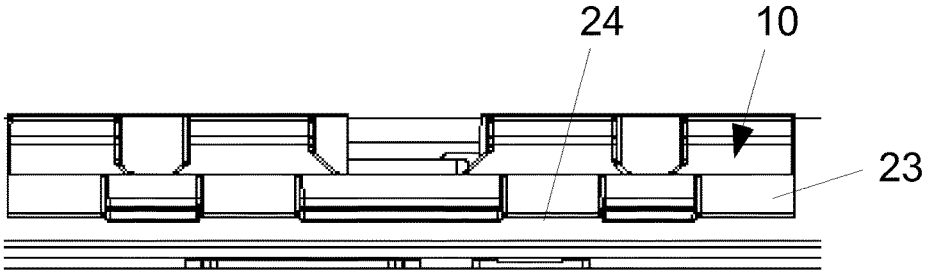
FIG. 8 shows a front view of an upper guide element on the frame from FIGS. 1 to 3 and 5.
Figure 6:
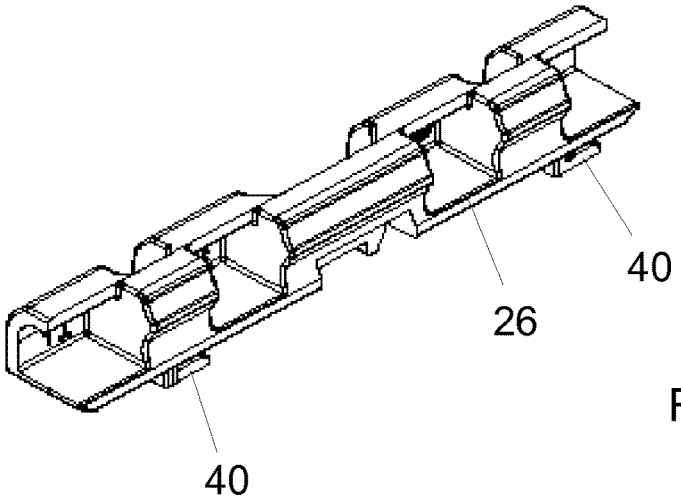
FIG. 6 shows a perspective view of a preferred embodiment of a second—upper—guide element for a frame, which for example is designed according to the type of FIGS. 1 and 2.
Figure 7:
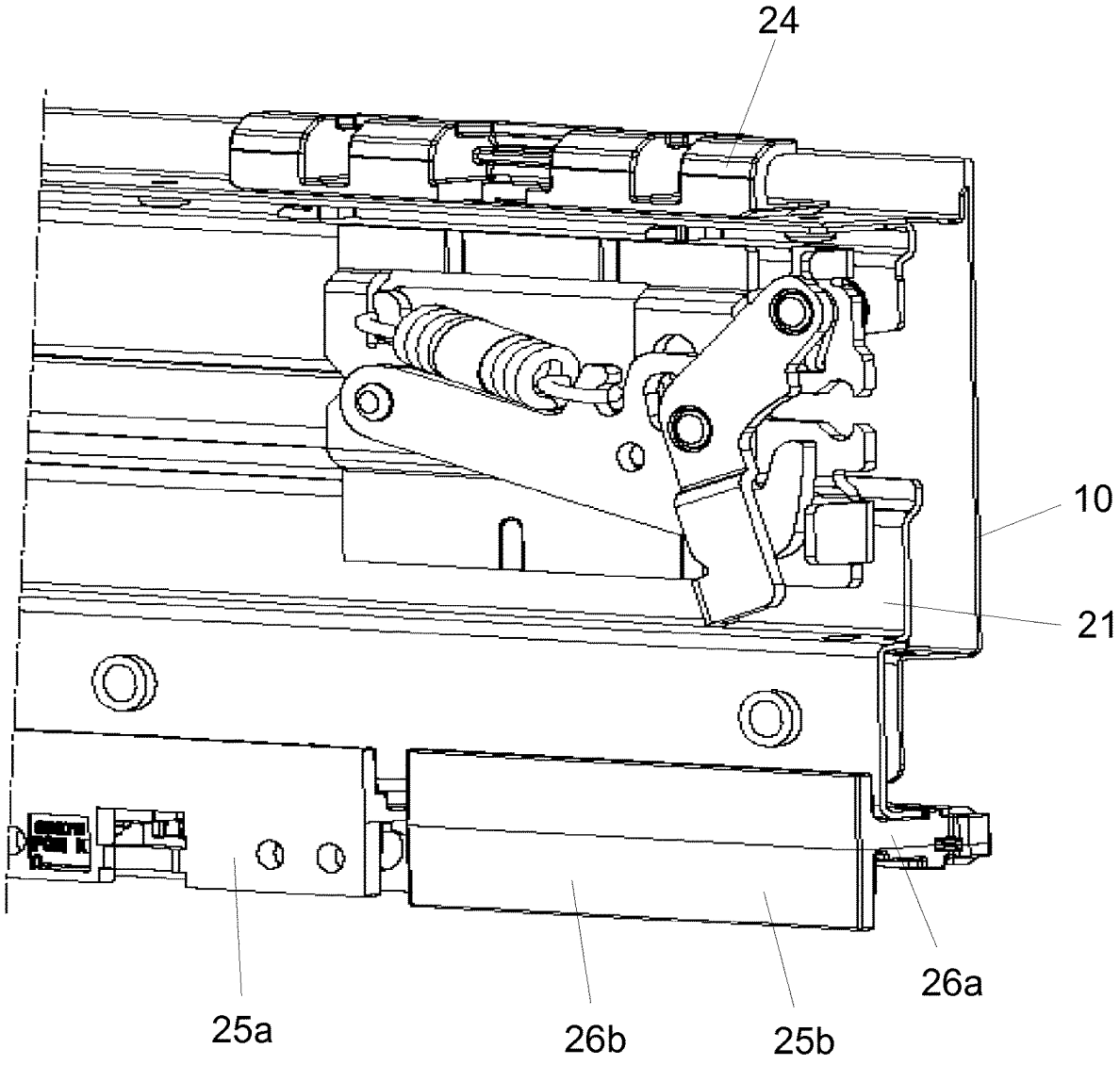
FIG. 7 shows a perspective view of an end region of the frame from FIGS. 1 to 3 and 5.

(Short) vertical webs 32 of the guide elements 25*b* engage in slots 33 of the cross beam 27 of the inner shell 10 and thus additionally secure the edge area of the frame against pulling apart the outer shell 11 and the inner shell 10 (see in particular also FIG. 5*b*).

The lower vertical leg 26*b* of these outer guide elements 25*b*, which form a second type of lower guide elements, engages in the lower guide groove 15 of the outer shell 11. In this way, the third lower sliding guide S3 is easily formed.

The two sliding guides S2 and S3 thus allow only limited displaceability corresponding to the distance between the two guide elements 25*a, b* of different type. However, this is sufficient to provide access to the functional devices described above in the interior between the inner shell 10 and the outer shell 11 (see again FIG. 16).

In total, with the two types of lower guide elements 25*a* and 25*b*, two different lower sliding guides S2, S3 are formed between the outer shell 11 and the inner shell 10, which allow at least a limited displacement until the guide elements 25*a, b* abut each other.

The first guide elements 25*a* are preferably fixed to the outer shell 11 at its guide groove by a forming process, for example, in such a way that the joining process leaves no visible traces on the opposite side of the outer shell "on the outside".

According to FIG. 3*c*, four of the middle guide elements 25*a* of the first type are provided as examples. In addition, two of the outer guide elements 25*b* of the second type are provided, which are each provided in the end area (i.e. towards the front panel and towards the rear panel) of frame 1. These outer guide elements 25*b* in particular stabilize the outer end regions between the inner shell 10 and the outer shell 11. The outer guide elements 25*b* may each have a detent means such as a detent hook 28, which is/are fastened to a corresponding detent means—for example to a window 29 here on the (continuously or sectionally provided) guide groove 15 of the outer shell 10.

All lower guide elements 25*a, b* are preferably approximately T-shaped in section, so that three legs 26*a, b, c* are formed on them, which can engage in corresponding grooves of the outer shell 11 and or the inner shell 10.

Figure 13:
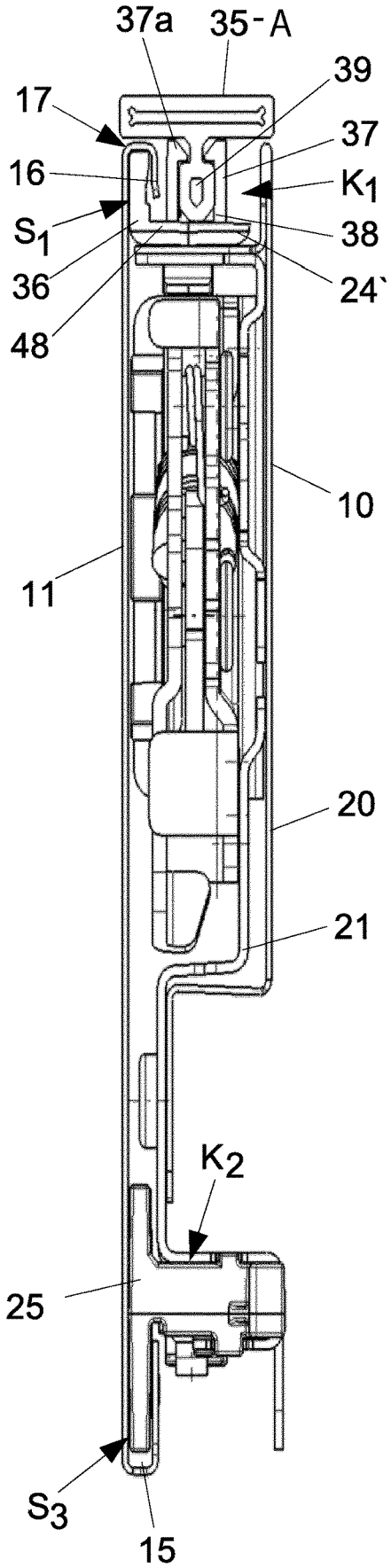
FIG. 13 shows a side view of a further frame with a three-part structure with inner shell, outer shell and cover strip, wherein upper and lower guide elements are provided.
Figure 14:
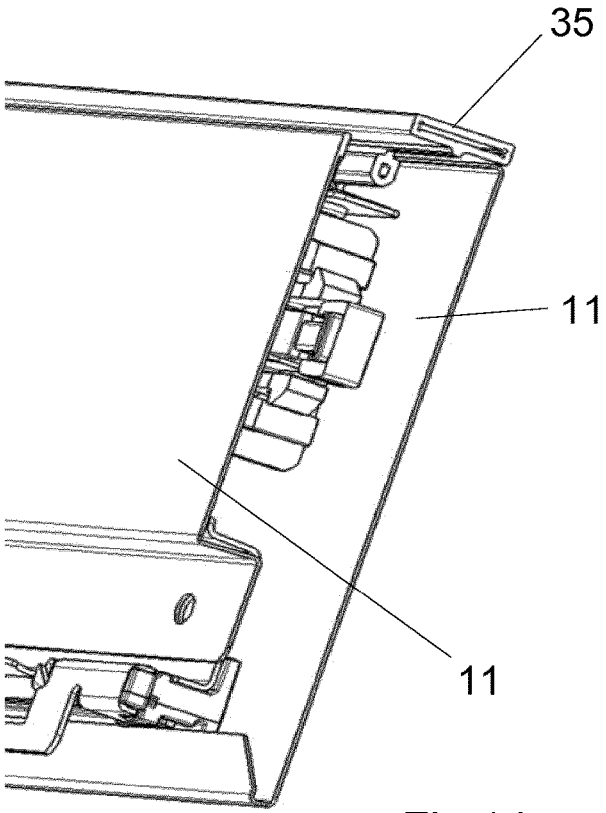
FIG. 14 shows a perspective view of a frame with a cover strip with a recess.
Figure 15:
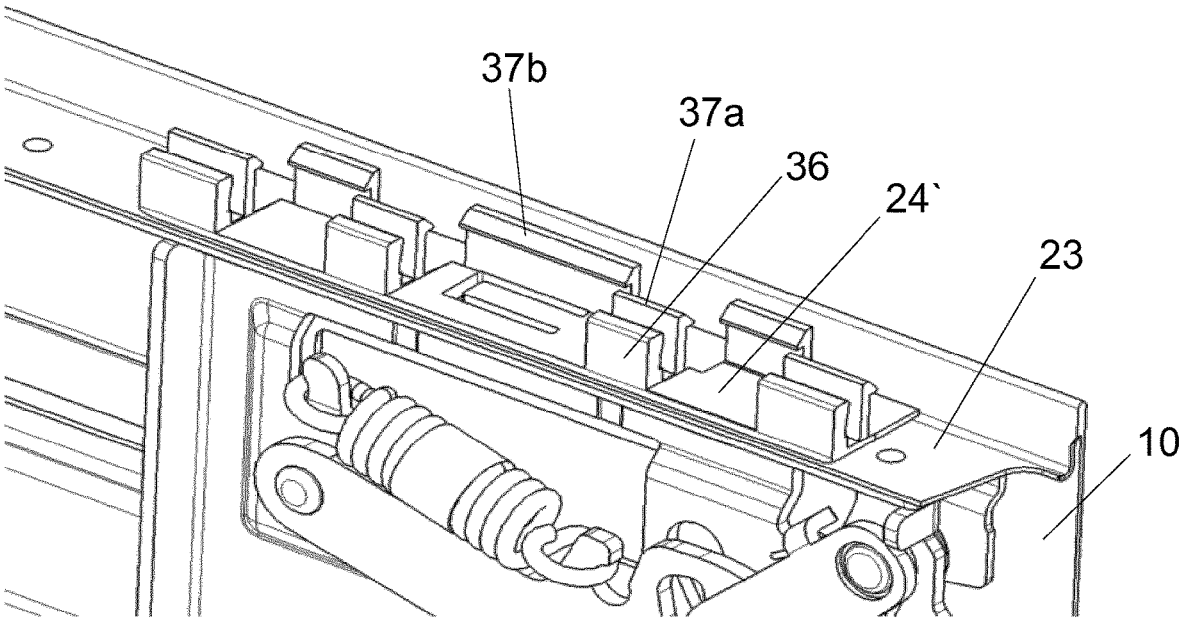
FIG. 15 shows a perspective view of an edge section of an inner shell with an upper guide element.

According to one embodiment—see FIG. 13 *ff*—a further component is provided on the shell of frame 1. This component is a cover strip 35-A.

When mounted, this cover strip 35-A optically closes off the inner shell 10 from the outer shell 11 and thus replaces the upper horizontal web 18 of the outer shell 11. The cover strip has a recess towards the rear wall 12*a* (with the width B of the rear wall 12*a*).

The cover strip 35-A, like a decorative strip, offers the advantage that it can easily be used to provide further optical and functional variants of the frame or frames without having to fundamentally change the structure of the frame. This means that cover strips 35-A in different colors and/or shapes can be provided in order to be able to easily modify the design of the frame upwards to suit the customer's individual requirements and/or to be able to easily realize attachments or the like on the frame. The decorative strip complements the inner shell 10 and the outer shell 11 in comparison with FIG. 3 (two-part shell) to form a shell that can also be described as a three-part shell.

In this case it can be provided that the upper edge 16 of the outer shell 11 may still be converted into a kind of guide groove 17, but into a narrower upper guide groove 17, in which the first upper guide webs 36 of the upper guide elements 24' engage.

Further guide webs 37*a, b* on the upper guide elements 24' can be formed on the upper guide elements 24', in which one or more webs 39 of the cover strip 35-A can engage, so that this is also slidably guided on the inner shell 10. The guide webs 37*a, b* can also be formed to be spring-loaded so that when the web 39 is pushed vertically to the drawer bottom, they move out of the way. The guide webs can also form a type of dovetail guide groove 38 and the web 39 can be formed in a dovetail-like manner. The guide elements 24' thus have the advantage of performing a double function for guiding both the outer shell 11 relative to the inner shell 10 and for guiding the cover strip 35-A on the outer shell 11 or on the inner shell 10.

The guide elements 24 and 24' each have a base on which one or more of the guide webs (36, 37*a*, 37*b*) are formed.

It is advantageous if the inner shell 10, with the exception of the guide elements 24', is constructed identically to the embodiment variant of FIGS. 1 to 12, so that further variants of frames can be provided or converted to such by virtually simply exchanging the upper guide elements 24 for the other guide elements 24' and providing the other outer shell 11 and the cover strip 35.

Figure 19:
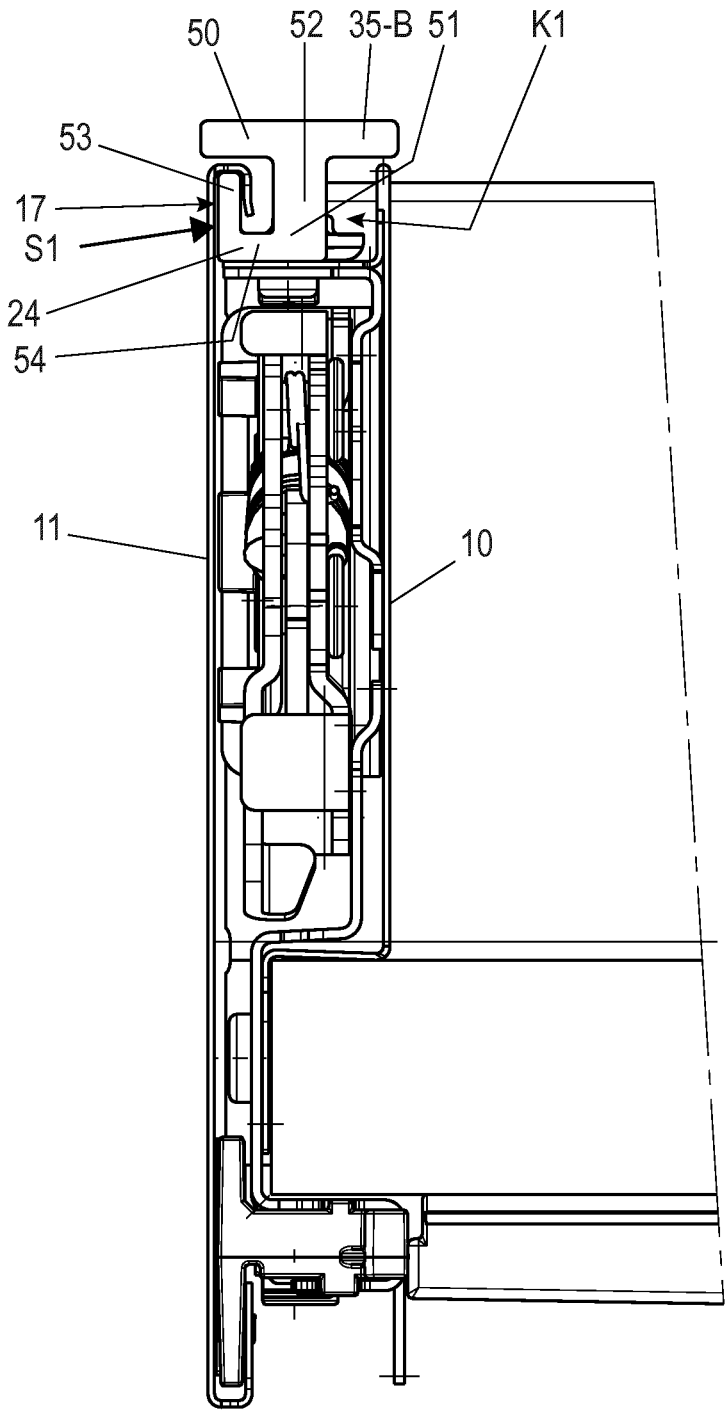
FIG. 19 shows a side view of a section of a further frame having a structure with inner shell, outer shell and a one-piece cover strip.
Figure 20A:
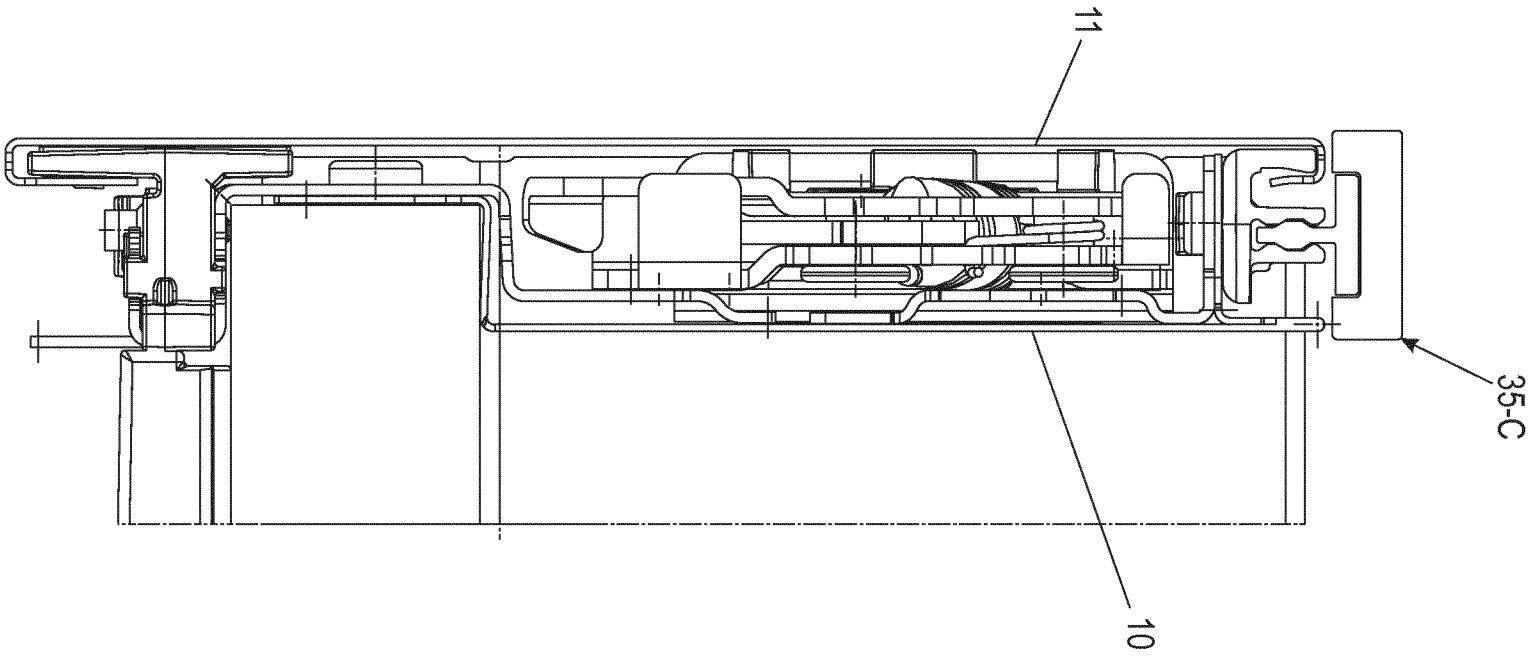
FIG. 20 shows in a) a side view of a section of a further frame having a structure with an inner shell, outer shell and a multi-part cover strip, in b) an enlargement of a section from a), in c) an exploded view of the multi-part cover strip from a) and b), and in d) a section of a drawer having a frame of the type shown in FIG. 20*a*)
Figure 20B:
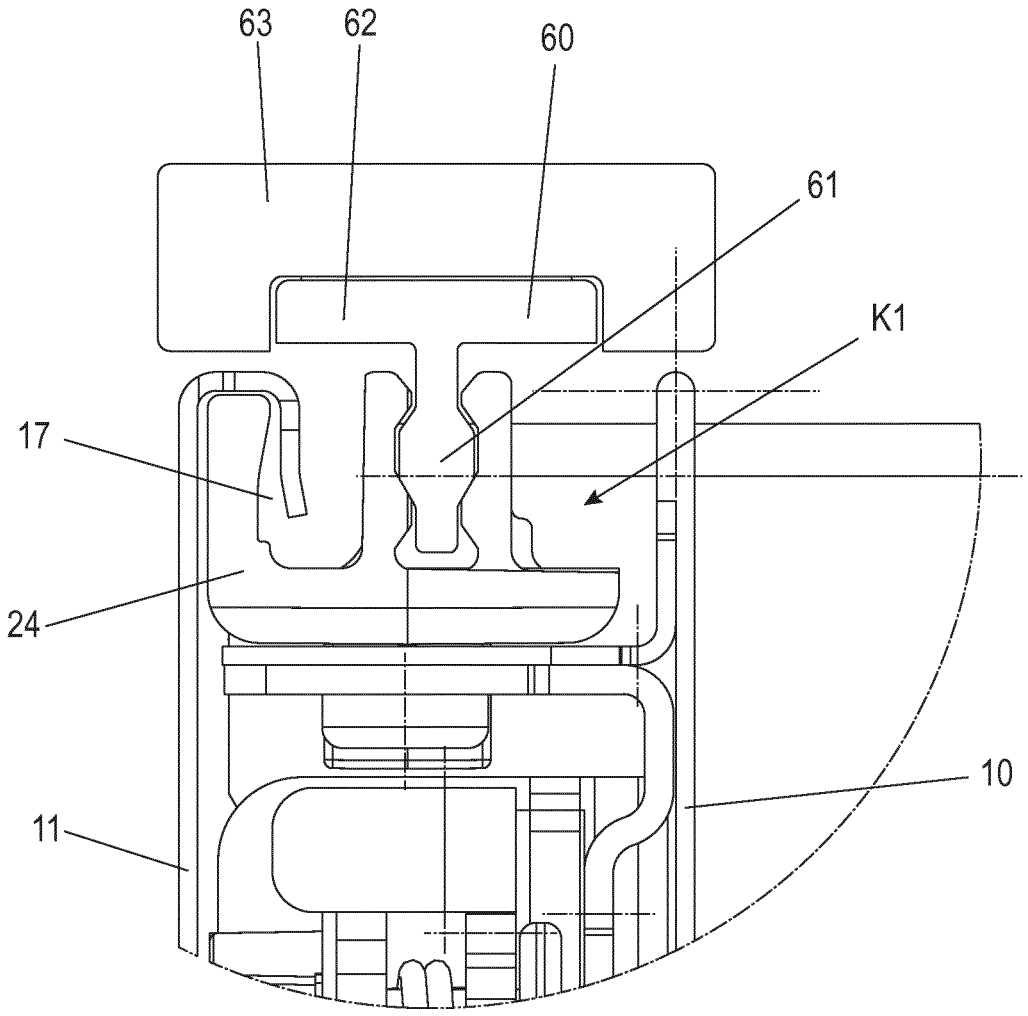
Figure 20C:
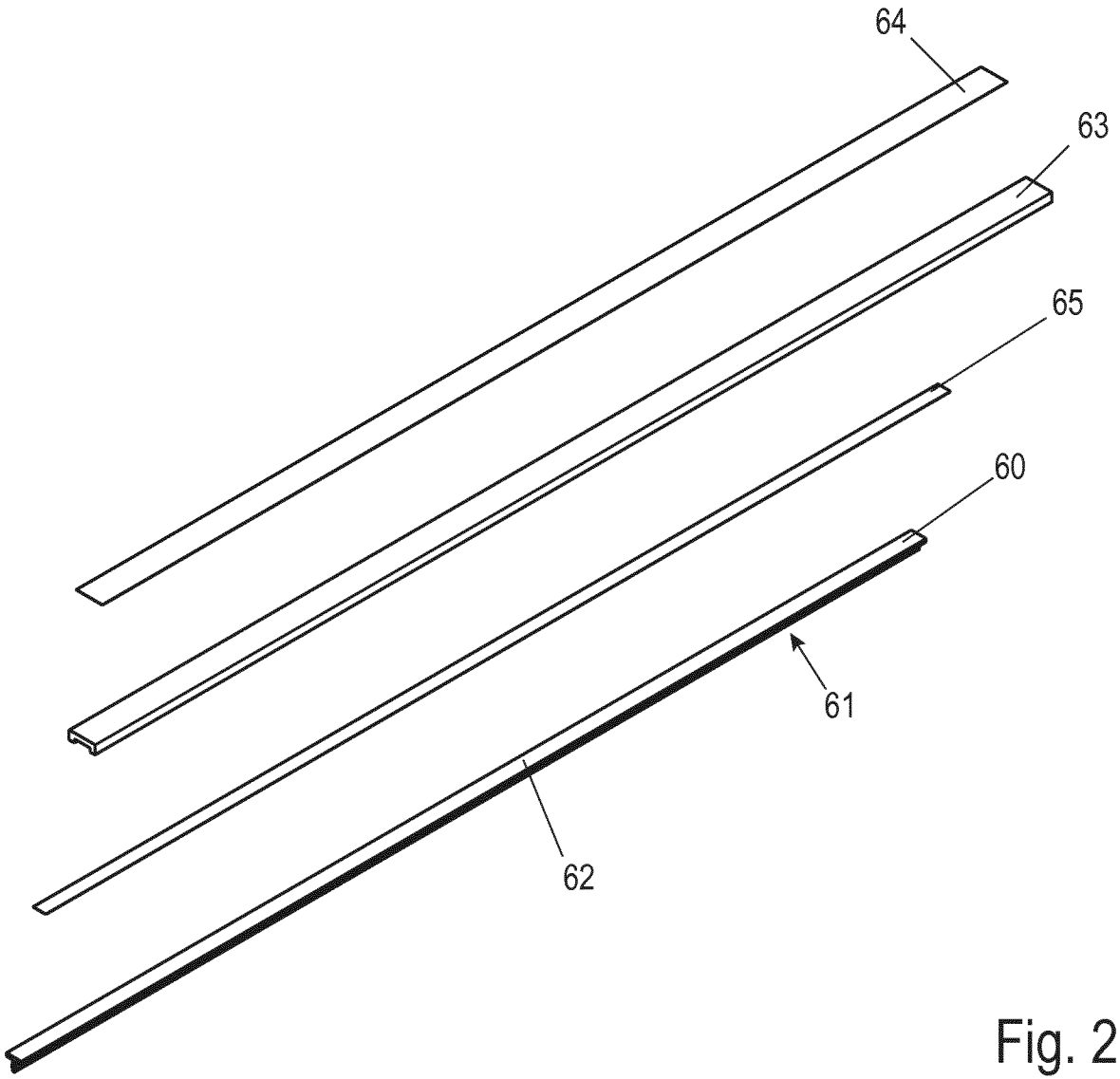
Figure 20D:
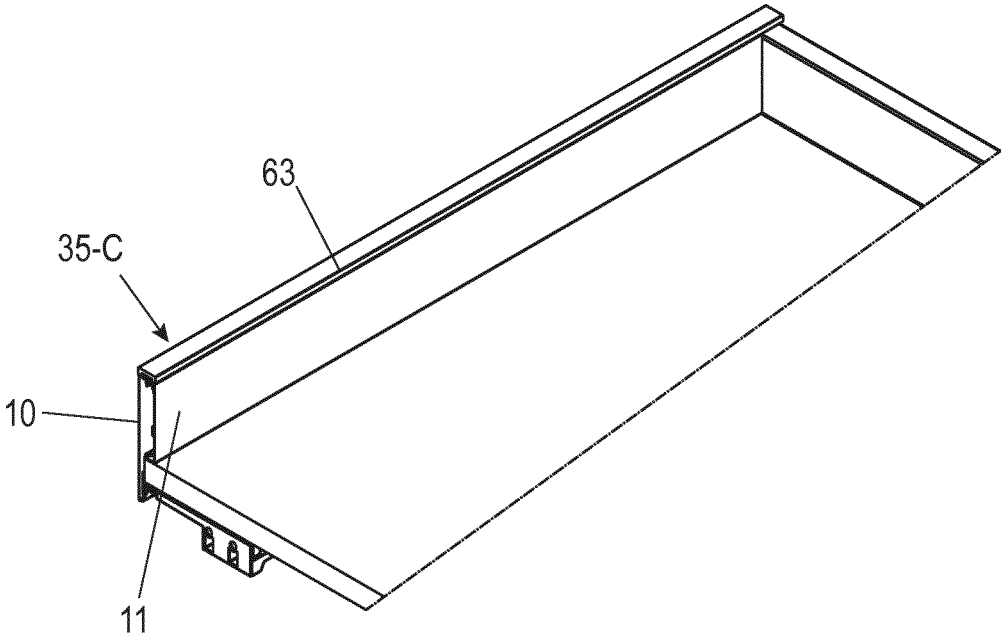

Also according to the variant of FIG. 19, a cover strip 35-B is provided on the shell of frame 1. According to this (in deviation from FIG. 13), one or more upper guide elements 24 together with the cover strip 35-B are designed in one piece.

For this purpose, the cover strip 35-B has a cover leg 50 which covers the receiving channel K1. The cover strip 35-B also has a foot 51 connected to the cover leg 50. This foot 51 here is U-shaped and has two longitudinal legs 52, 53 and one transverse leg 54. The one of the longitudinal legs 52 is connected to the cover leg 50 and the other longitudinal leg 52 engages in the groove 17 as the upper sliding guide.

The cover strip 35-B—as well as the other cover strip variants described in this document—can be manufactured in various ways. They can be designed as an injection-molded part or as a cast part or as a cut-to-length piece of an extruded profile. They can also be made of a wide variety of materials, in particular plastic or light metal.

The solution of FIG. 19 is more cost-effective than that of FIG. 13, which, however, allows an even greater variety of designs.

FIGS. 20 *a-d* also show another variant of a cover strip 35-C. This cover strip 35-C is similar to the cover strip 35-A of FIG. 13 with regard to the way it is fitted.

When mounted, the cover strip 35-C also optically closes off the inner shell 10 from the outer shell 11, thus replacing here at least the upper horizontal web 18 of the outer shell 11. The cover strip has a recess towards the rear wall 12*a* (with the width B of the rear wall 12*a*).

The cover strip 35-C also may function as a decorative strip in the same way that it can be used to easily provide other optical and functional variants of the frame or on frames without having to fundamentally change the structure of the frame.

Between the cover strip 35-C and guide elements 24 there is again a fastening. This can be designed as a dovetail guide, which enables displacement in the longitudinal direction of the frame and/or clipping in vertically to the longitudinal direction of the frame of the cover strip 35-C on the guide elements 24.

The cover strip 35-C itself is designed in several parts. According to FIG. 2, a strip base 60 is provided for attachment to the guide elements 24. The strip base 60 here is T-shaped in cross-section and has a lower, here vertical, fastening foot 61 and an upper, here horizontal, mounting leg 62. The mounting leg 62 is designed in such a way that a cover strip 63 can be placed on it. This cover strip 63 is the element that is actually visible from the outside. The cover strip 63 can in turn be coated with a cover foil 64 (FIG. 20*c*), e.g. with a self-adhesive cover foil 64. An attachment is formed between the cover strip 63 and the horizontal mounting leg 62. This attachment may have an adhesive film 65, preferably a double-sided adhesive strip 65, which is placed between the receiving leg 62 and the cover strip 63. In this way, the cover strip 63 can be easily and compactly attached to the horizontal mounting leg 62. However, it is conceivable to also provide other ways of fastening the cover strip 63 to the horizontal mounting leg 62, such as detent connections or the like.

The multi-part design of this selected structure ensures that there are a large number of possibilities for using simple means to provide a wide variety of cover strips 35-C in order to give the respective frame a preferred appearance. The strip base 60 is not changed for this purpose. The various variants can be implemented by preselecting or, if necessary, changing the cover strip 63.

Thus the cover strip 63 can be rectangular in cross-section as shown. However, it also can have a large variety of other cross-sections, thus a cross-section which is upwardly rounded off (not shown). In addition, the cover strip 63 can also be made of a wide variety of materials, particularly those that would be less suitable for direct attachment to the frame, but which offer a particularly attractive appearance. According to one variant, the cover strip 63 then consists of a wood-based material or a wood substitute material. But it can also be made of plastic or metal, or it can be made of ceramics, for example.

Figure 23:
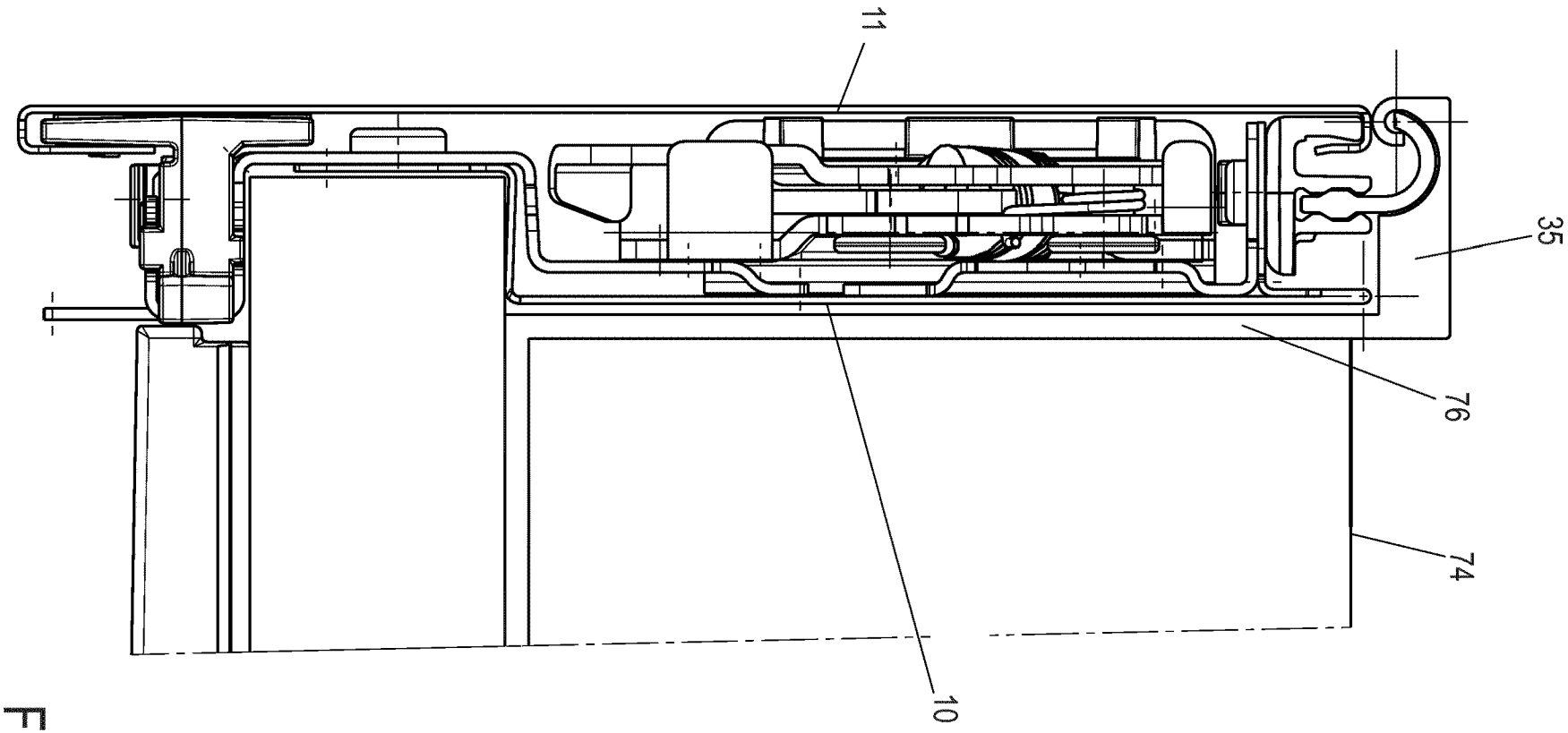
FIG. 23 shows a variant of the drawer from FIG. 22.

Further variants of cover strips 35 are characterized in that the respective cover strip 35 is used to implement one or more further functions. Variants of this embodiment are shown in FIGS. 21 to 23.

The first of the variants is illustrated by FIG. 21*a-g*.

According to FIG. 21*a-g* (see in particular FIG. 21*c*) it is intended to provide a cover strip 35-D with a first guide means 70, on which a top strip 71 with a corresponding second guide means 72 can be placed. The cover strip 35-D here is basically similar to the cover strip 35 from FIG. 13 and is arranged analogously on the frame. But it has the first guide means 70.

The first guide means 70 may be configured as a groove or web in the main extension direction of strips 35-D and 71 and the corresponding second guide means 72 on the top strip 71 may be configured as a web or groove corresponding to the first guide means 70. Together these two guide means form a sliding guide.

A functional element can be attached to the top strip or it can be molded directly onto it.

According to FIG. 21, the functional element is placed on the top strip 71. As further illustrated in FIG. 21, the functional element can be designed as a top drawer 73. The top drawer is then preferably connected to two side frames 100, each with one of the base strips 71, which can each be attached to one of the two side frames of a drawer. If the frame length of the top drawer is smaller than that of the frame on which it is mounted, it can be moved to a limited extent on these two frames.

The top drawer can be designed in a simple integral design with the base strips and can be made of plastic, for example. This embodiment is not shown here. It can, however, also be made up of several parts and be constructed like the drawer on which it is mounted, especially with regard to the frames. It is then shorter than the bottom drawer only in its direction of movement or insertion. These variants are shown in FIG. 21 *a*) to *g*). In this way, the top drawer 73 is optically well matched to the drawer on which it is mounted.

Figure 21A:
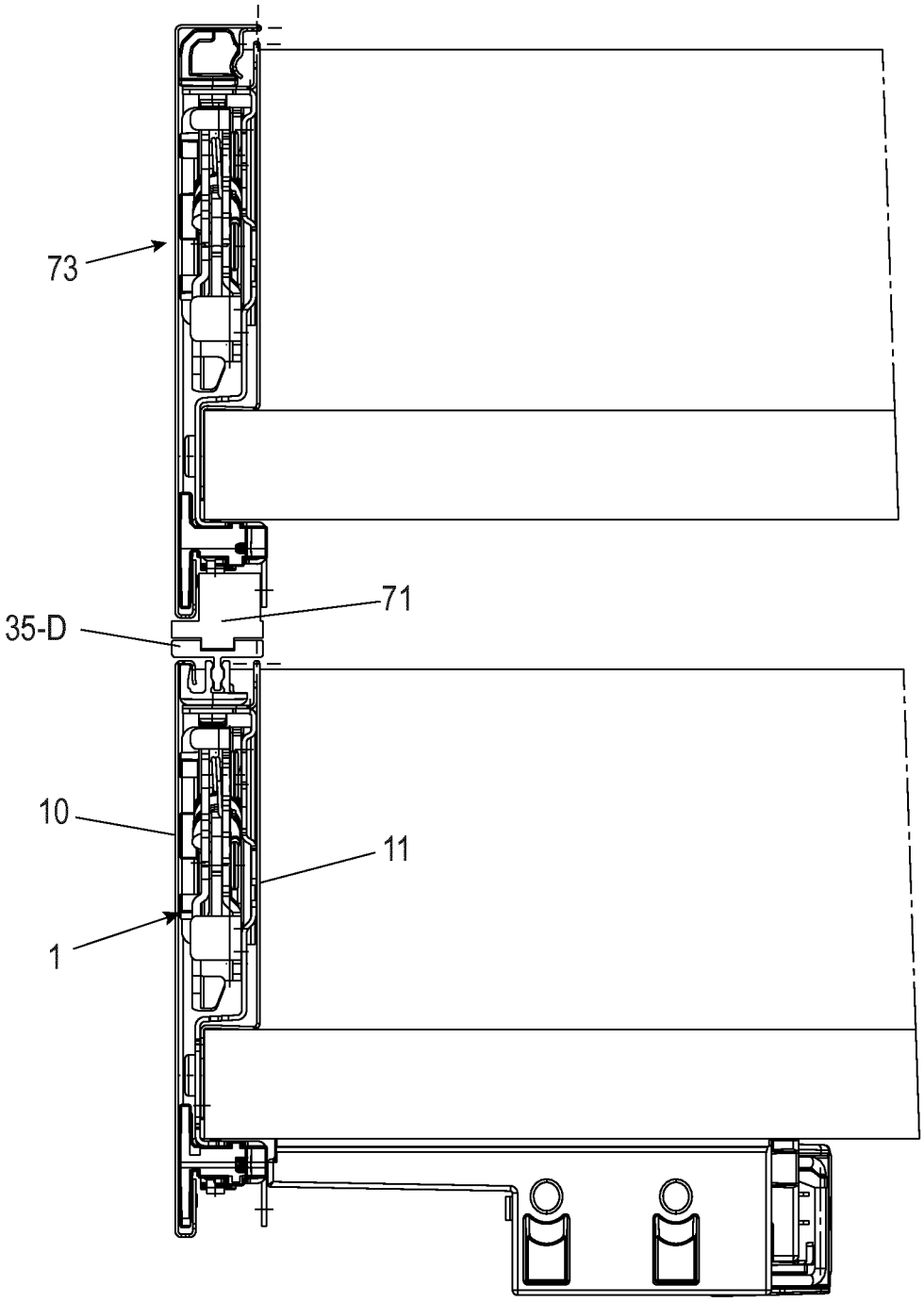
FIG. 21 shows in a) a side view of a section of a drawer having a frame with a structure with an inner shell, outer shell and a cover strip, on which a top drawer is placed; in b) and c) the elements from a) in a partial exploded side view and in a partial exploded perspective view, in d) a section enlargement from a); in e) a perspective view of the elements from a), wherein in each case only one side frame is shown on the drawer and on the top drawer, in f) a further perspective view of the arrangement from e), here without front panel and in g) a detail enlargement from f)
Figure 21B:
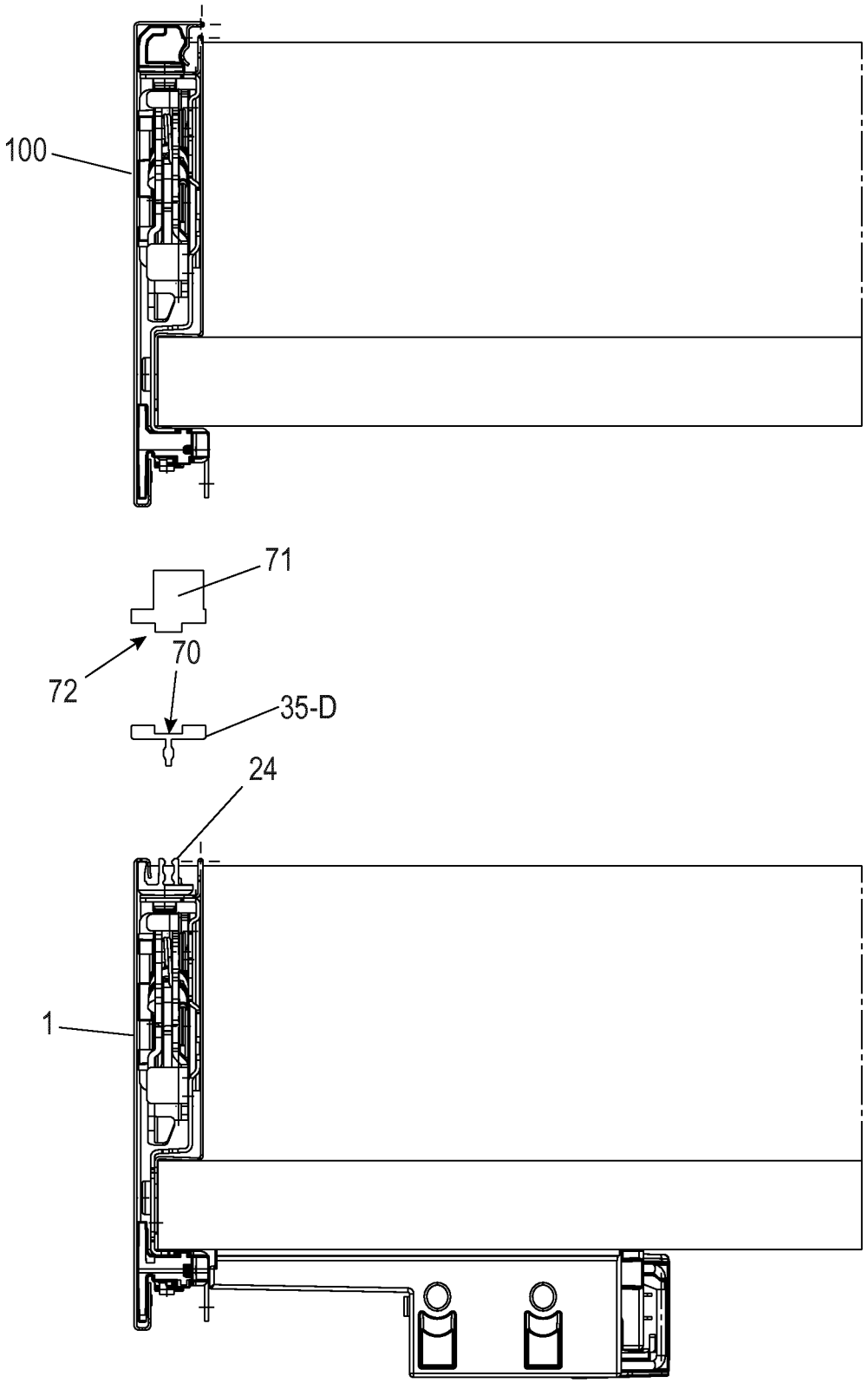
Figure 21C:
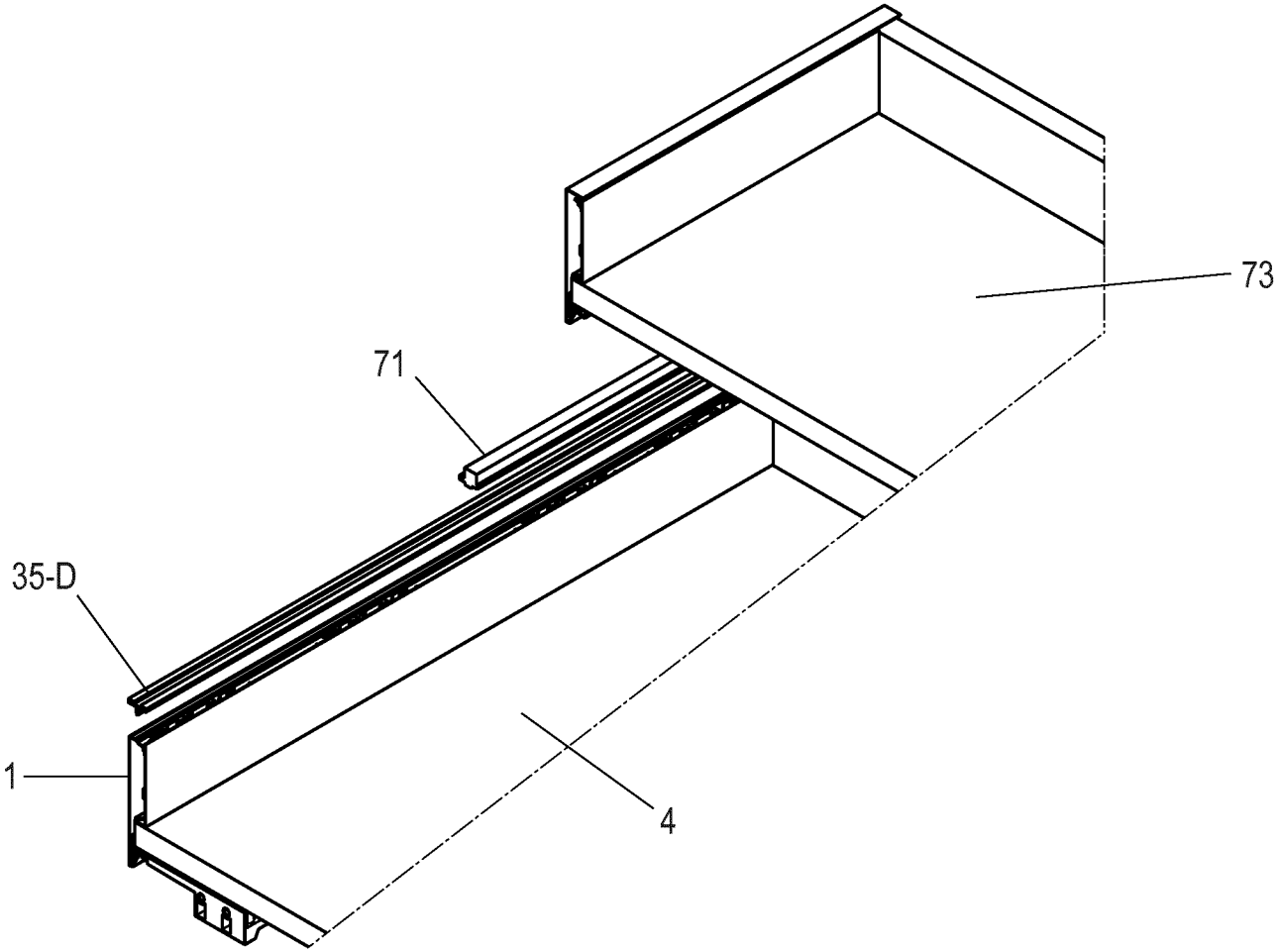
Figure 21D:
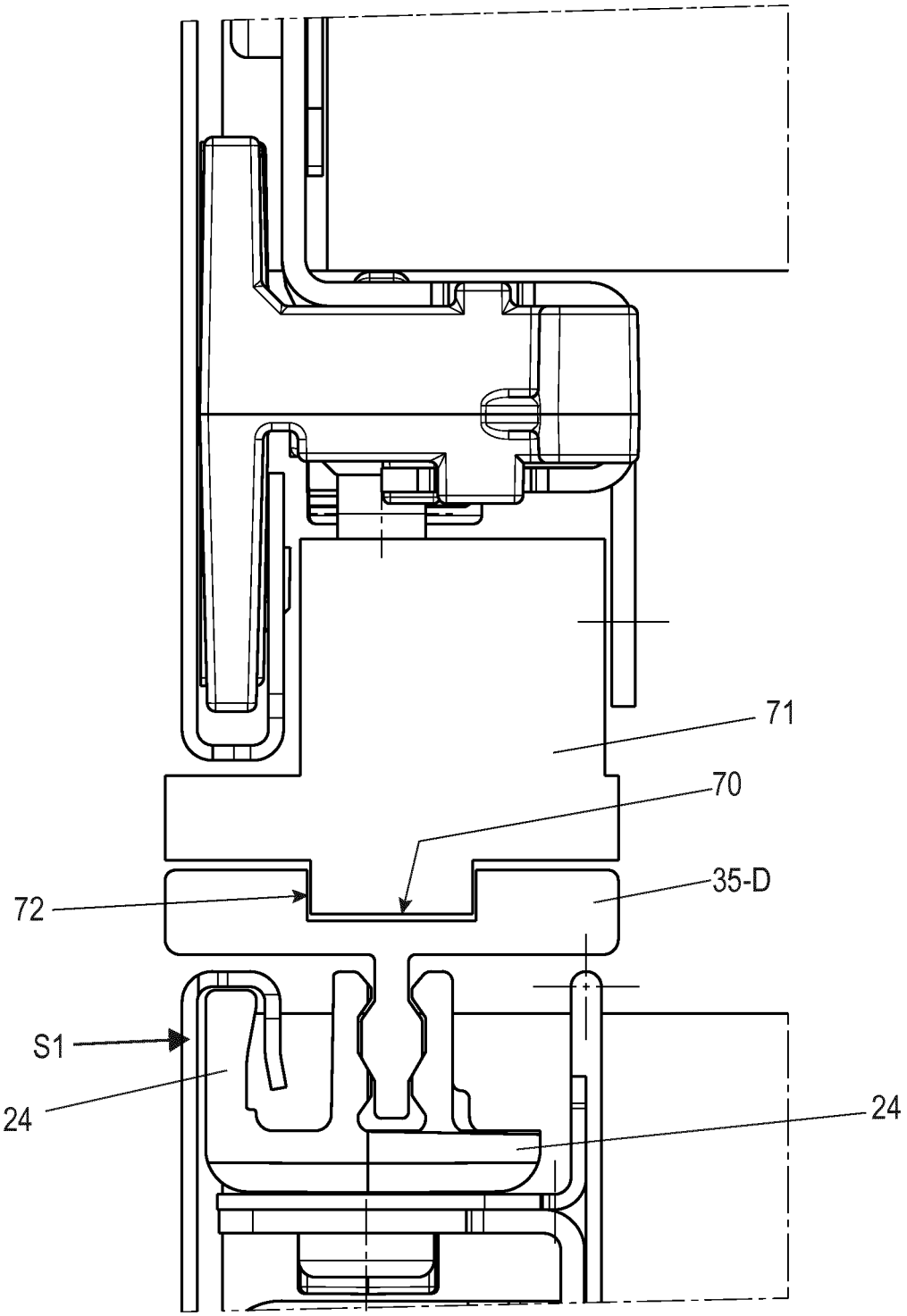
Figure 21E:
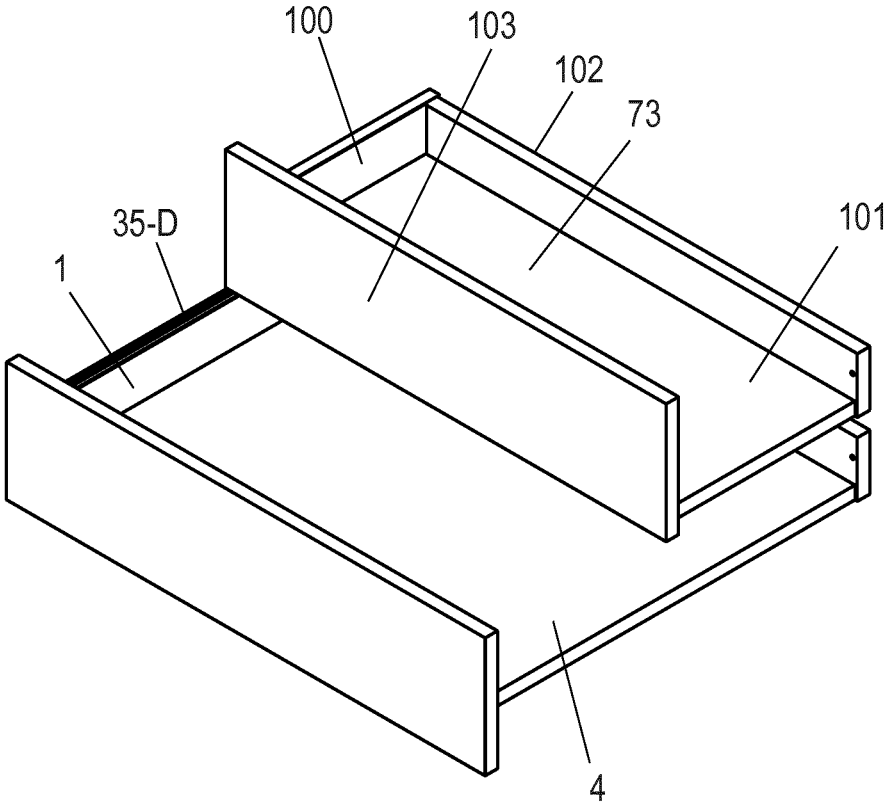
Figure 21F:
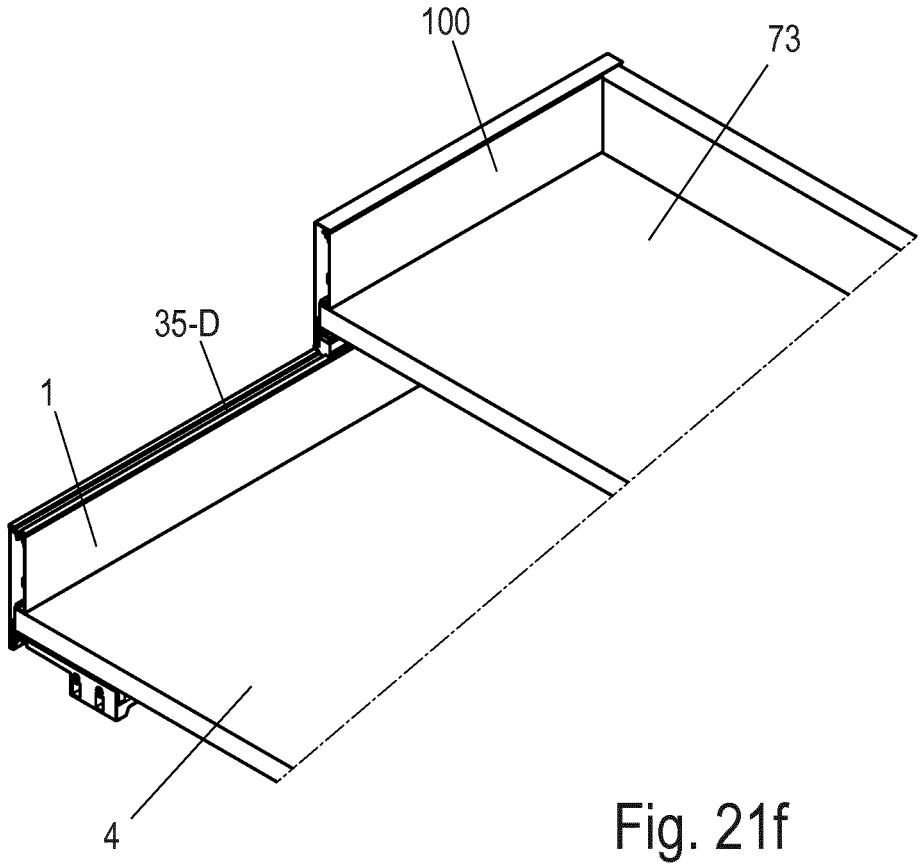
Figure 21G:
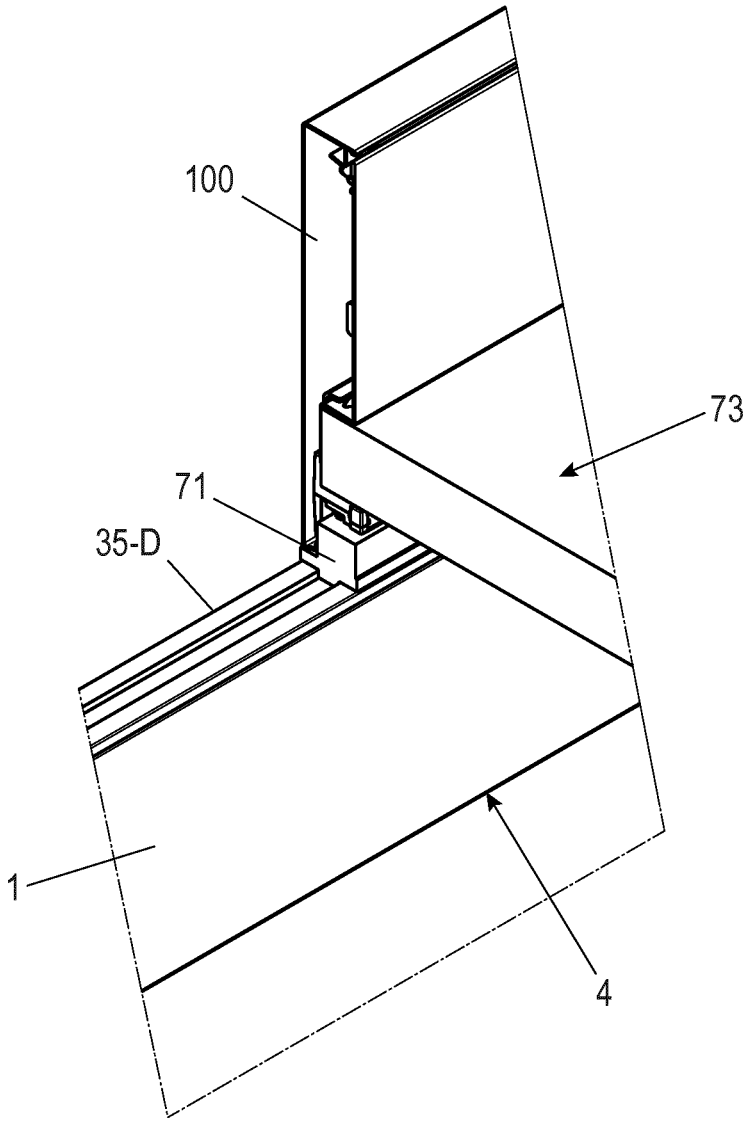
Figure 22A:
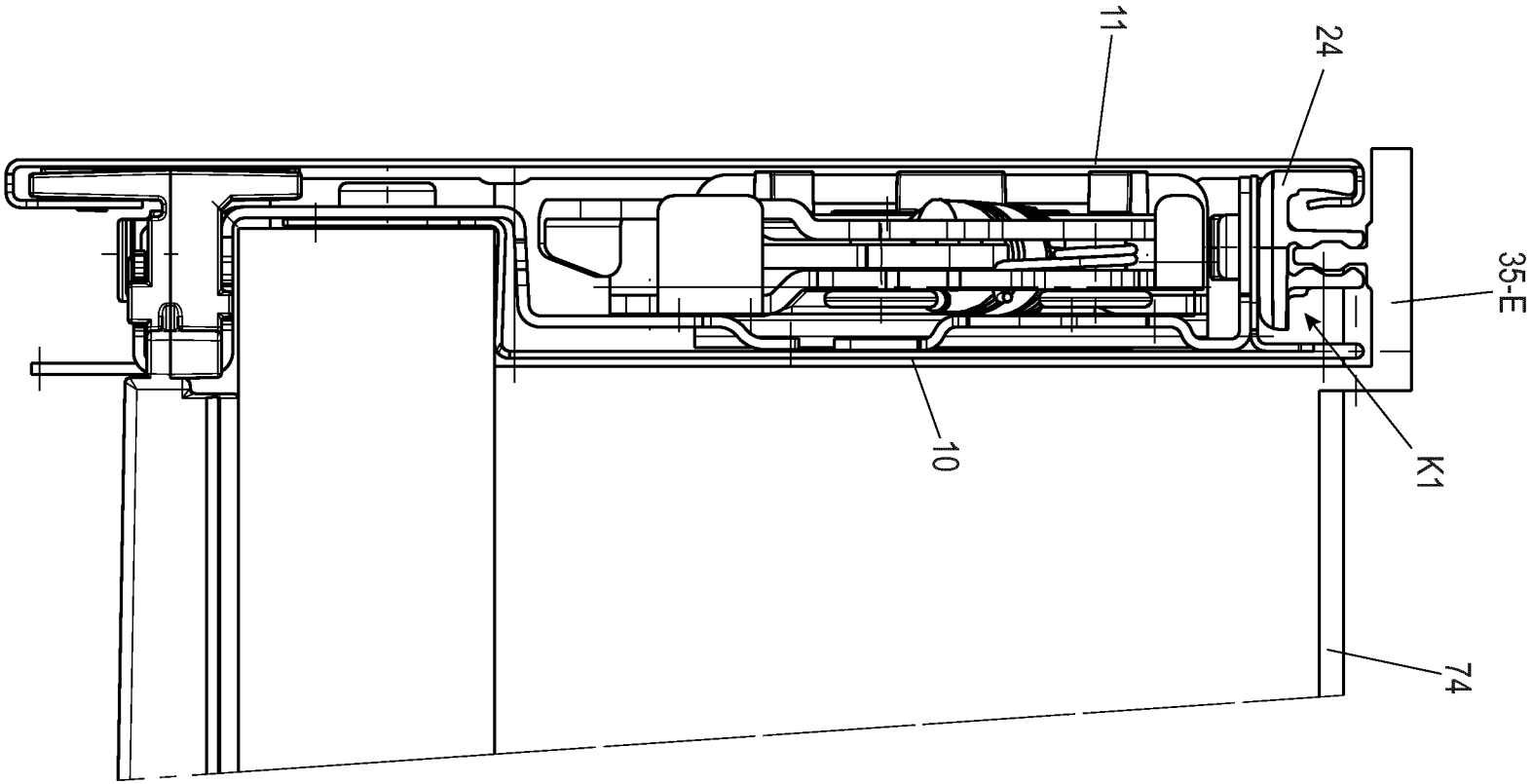
FIG. 22 shows in a) a side view of a section of a drawer having a frame with a structure with an inner shell, outer shell and a cover strip, on which a drawer inner insert is formed, in b) a perspective view of a section of drawer according to the design from a), and in c) and d) further views of sections of drawers according to the type from FIG. 22*a*)
Figure 22B:
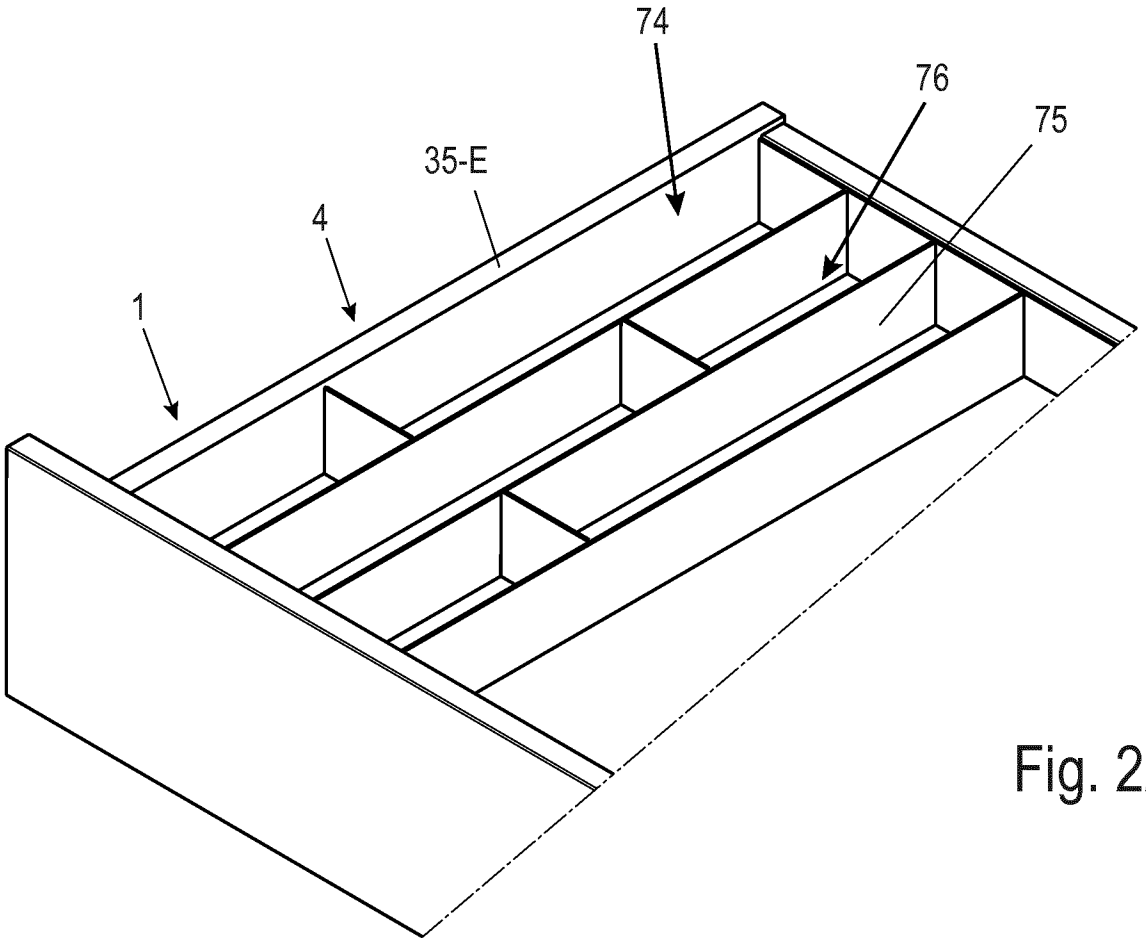
Figure 22C:
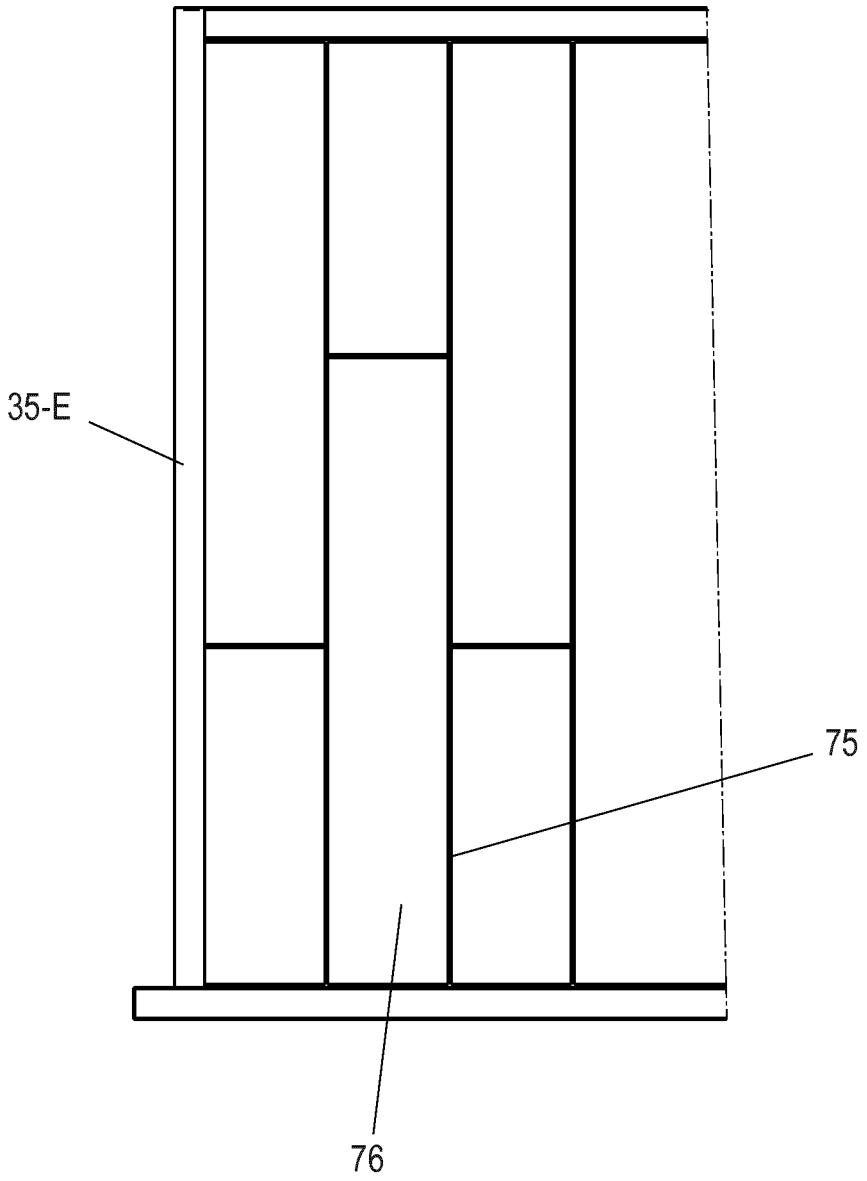
Figure 22D:
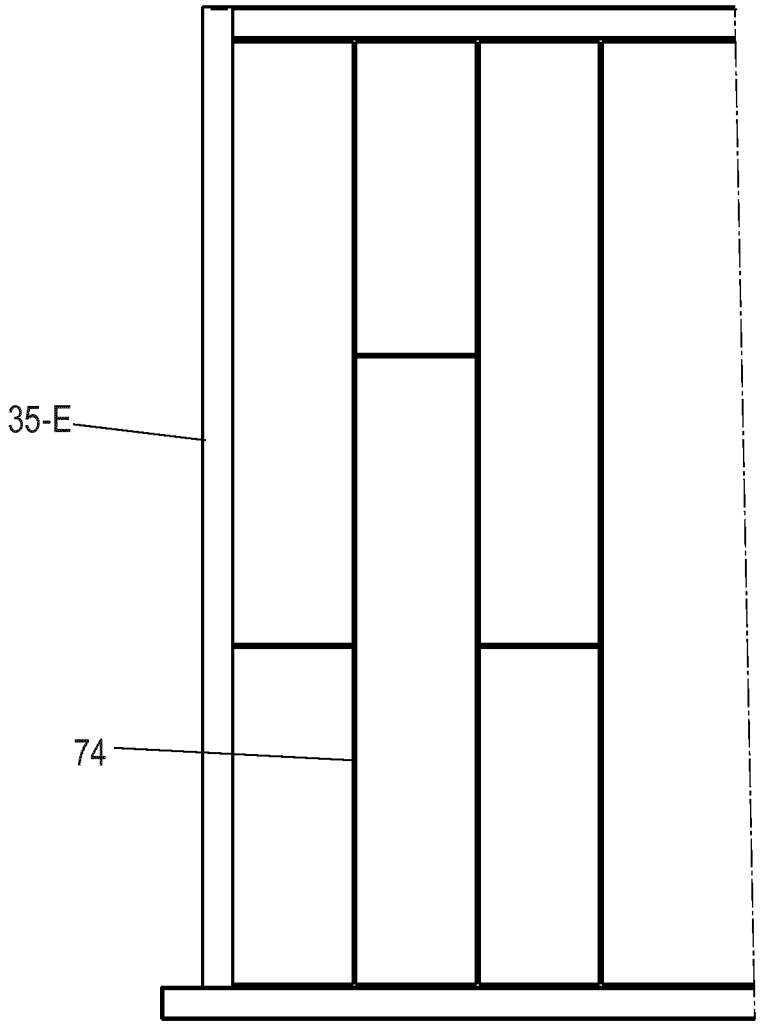

It can also be provided in this case that the top strip 71 engages at the bottom in the frame 100 of the top drawer 73, for example it is clamped and/or engaged. The top drawer has two side frames 100 which are fitted in this way to the lower frames of the lower "main drawer" 4. It may also preferably have a base 101, a rear panel 102 and a front panel 103 (FIG. 21*e*).

FIG. 22 *a*) also shows a side view of a section of a drawer with a frame with a configuration with inner shell, outer shell and a cover strip 35-E, on which an internal drawer insert 74 is designed as a functional element. The cover strip is essentially designed as in FIG. 13 and can be mounted to the frame as in this case. The internal drawer insert 74 laterally adjoins the cover strip 35-E. It can be integrally molded onto said strip. Preferably, one of the cover strips 35-E is formed on each side of the internal drawer insert. The two cover strips 35-E can be designed in one piece with the internal drawer insert 74. The internal drawer insert 74 can be designed to be placed in the drawer in a vertical positioning movement. However, it can also be provided that it can then be pivoted together with one into its end position. FIG. 23 shows such an embodiment.

The internal drawer insert 74 is thus easy to assemble. It may contain one or more interior partitioning means, e.g. it can have one or more walls 75 that divide it into compartments 76.

Figure 24:
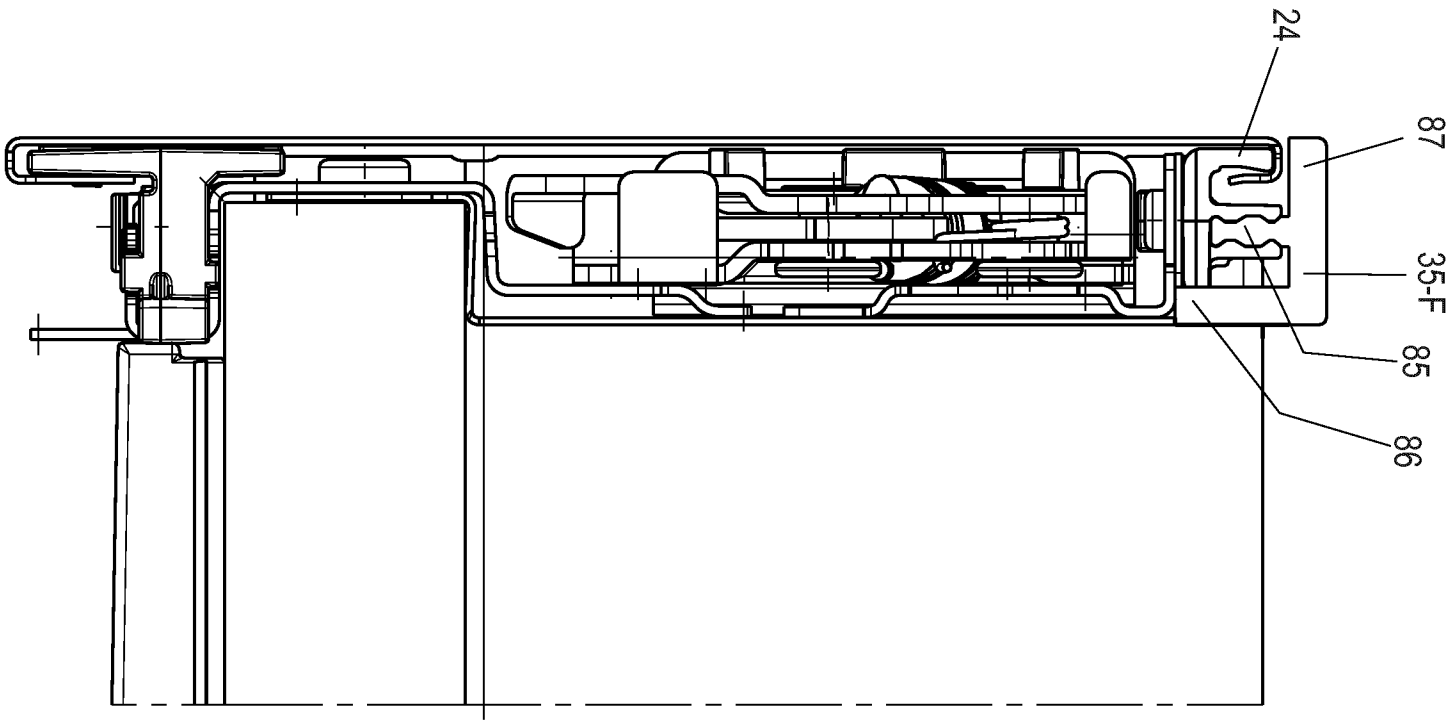
FIGS. 24, 25 each show a side view of a section of further drawers with a frame with a structure with inner shell, outer shell and a cover strip.

According to FIG. 24 the cover strip 35-F has an F-shape with two vertical legs 85, 86 and one horizontal leg 87. The horizontal leg 87 forms the actual optical end of the frame towards the top. The one vertical leg 86 is used for fixing to one of the several guide elements 24, as described for example in FIG. 13. As already discussed, the cover strip 35-A shown in FIG. 13 has a T-shape. In the embodiment example of FIG. 24, this T-shape is supplemented by the second vertical leg 86. The further vertical leg 86 of the cover strip 35-F directly replaces an upper section of the inner wall, in particular the inner shell 10 of the frame, so that an upper receiving channel K1 is formed with this vertical leg again in a simple manner, which is essentially closed around the circumference except for the gap.

Figure 25:
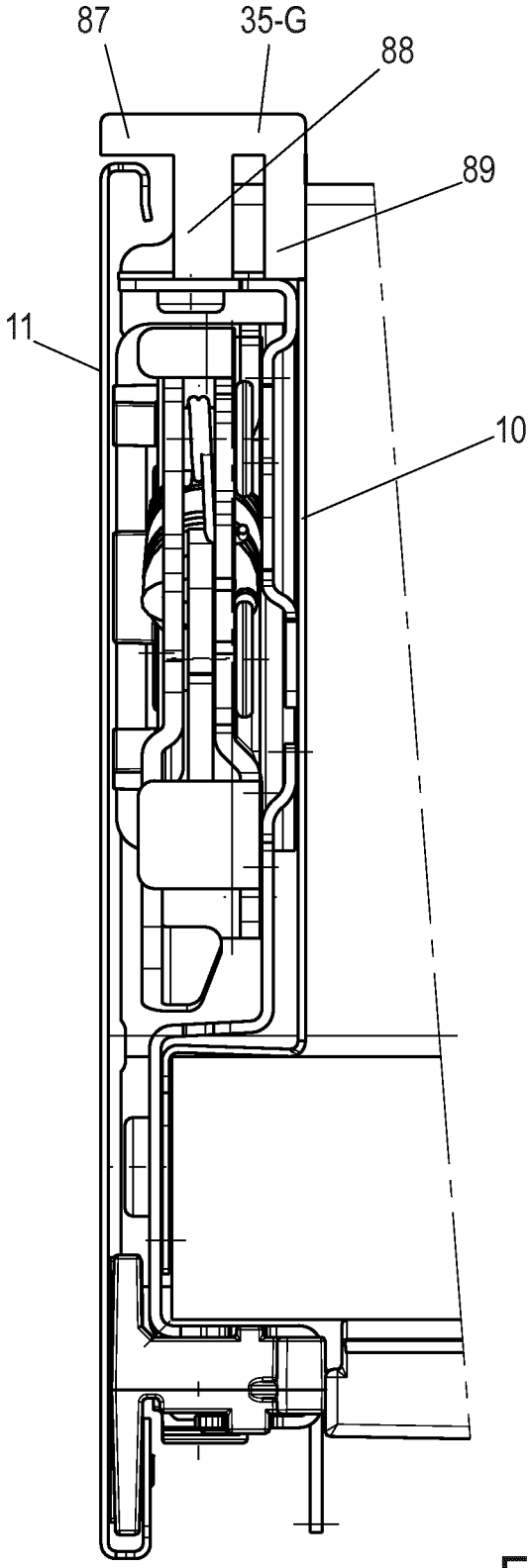

According to FIG. 25, the cover strip 35-G is again F-shaped. Its two vertical legs 88, 89 are arranged on the frame. An upper sliding guide is not provided or is implemented completely independently of the cover strip 35-G with guide elements not shown here.

The cover strip 35-G can be attached to the frame 1 in different ways—e.g. adhesive or latching. It forms an attractive upper optical finish of frame 1. It has an F-shape with two vertical legs 88, 89 and the horizontal leg 87, wherein the two vertical legs 88, 89 are directed downwards towards the frame and can rest on it.

The invention claimed is:

1. A frame for a drawer having a base, at least one such frame, a front panel, and a rear panel, the frame comprising:

an inner shell and an outer shell fastened to the inner shell, wherein a vertically upper contact region or a gap between the outer shell and the inner shell is covered by a cover strip, wherein the inner shell is shorter than the outer shell by a first predetermined length, thereby defining a space configured to receive the rear panel proximate an inner side of the outer shell and rearward of the inner shell, wherein the cover strip has a horizontal leg and a vertical leg, the vertical leg configured for engagement with at least one of the inner wall and the outer wall, and wherein the horizontal leg extends further than the vertical leg in a direction from the front panel toward the rear panel by a second predetermined length so that the rear panel may be received in the space, so that the horizontal leg of the cover strip overlies the rear panel, and so that the vertical leg of the cover strip extends no further than a front side of the rear panel.

2. A frame according to claim 1, wherein the cover strip covers the edges of the outer shell and the inner shell vertically upwards.

3. A frame according to claim 1, wherein the outer shell and the inner shell are displaceably guided relative to one another by one or two sliding guides, and wherein the one or at least one of the at least two sliding guides has one or more guide elements arranged between the outer shell and the inner shell.

4. A frame according to claim 1, wherein the one of the sliding guides is formed as an upper sliding guide and the at least one other of the sliding guides is formed as at least one lower sliding guide between the inner shell and the outer shell, and wherein at least the upper sliding guide and/or the at least one lower sliding guide has/have one or more of the guide elements arranged between the outer shell and the inner shell.

5. A frame according to claim 1, wherein one or more of the upper guide elements is integrally formed with the cover strip.

6. A frame according to claim 1, wherein the cover strip and one or more of the guide elements are assembled to form a unit.

7. A frame according to claim 1, wherein the cover strip is slidably arranged on one or more of the upper guide elements.

8. A frame according to claim 1, wherein the cover strip is structurally separate from the one or more of the upper guide elements and is not attached thereto.

9. A frame according to claim 1, wherein the cover strip is formed as an integral element.

10. A frame according to claim 1, wherein the cover strip is formed in several pieces.

11. A frame according to claim 1, wherein the cover strip is T-shaped in cross-section and has a horizontal leg and a vertical leg.

12. A frame according to claim 1, wherein the cover strip is F-shaped in cross-section and has a horizontal leg and two vertical legs.

13. A frame according to claim 1, wherein the horizontal leg of the cover strip is designed as a cover leg which covers a receiving channel of the frame upwards.

14. A frame according to claim 1, wherein the one vertical leg of the cover strip is designed as a cover leg which covers the receiving channel of the frame towards one side.

15. A frame according to claim 1, wherein the cover strip has a strip base for fastening to the frame, which is provided with an upper receiving leg on which a cover strip or a functional strip is placed.

16. A frame according to claim 1, wherein the cover strip is provided with a cover foil.

17. A frame according to claim 1, wherein the cover strip forms a lateral part of an internal drawer insert.

18. A frame according to claim 1, wherein the cover strip has a first guide means on which a top strip with a corresponding second guide means can be placed, wherein the two guide means jointly form a sliding guide.

19. A frame according to claim 1, wherein the top strip forms part of a top drawer.

20. A drawer comprising one or two frames according to claim 1.

* * * * *